US005850726A

United States Patent [19]

Degrasse et al.

[11] Patent Number: 5,850,726

[45] Date of Patent: Dec. 22, 1998

[54] WRAPPING APPARATUS AND METHOD

[75] Inventors: Steven E. Degrasse, New Albany, Ind.; Kenneth J. McDowell, Louisville, Ky.; Donnie Norris, Pleasureville, Ky.; Patrick R. Lancaster, III, Louisville, Ky.; David Eldridge, Ferncreek, Ky.

[73] Assignee: Lantech, Inc., Louisville, Ky.

[21] Appl. No.: 747,127

[22] Filed: Nov. 12, 1996

[51] Int. Cl.[6] ..... B65B 13/04

[52] U.S. Cl. ..... 53/588; 53/556; 53/210; 100/27; 100/28

[58] Field of Search ..... 53/399, 441, 465, 53/556, 588, 201, 210; 100/27, 28

[56] References Cited

U.S. PATENT DOCUMENTS

| | | | |
|---|---|---|---|
| 3,247,781 | 4/1966 | Meckler | 100/27 |
| 3,701,314 | 10/1972 | Tull | 100/27 |
| 3,885,678 | 5/1975 | Borg et al. | 214/1 BB |
| 4,132,318 | 1/1979 | Wang et al. | 214/1 BB |
| 4,593,517 | 6/1986 | Mattila | 53/441 |
| 4,666,050 | 5/1987 | Kreiger et al. | 212/211 |
| 4,829,753 | 5/1989 | Bricmont | 53/588 |
| 4,934,123 | 6/1990 | Salzsauler | 53/399 |
| 4,938,008 | 7/1990 | Salzsauler | 53/556 |
| 4,993,209 | 2/1991 | Haloila | 53/399 |
| 5,046,303 | 9/1991 | Becicka et al. | 53/540 |
| 5,107,657 | 4/1992 | Diehl et al. | 53/141 |
| 5,240,139 | 8/1993 | Chirnomas | 221/2 |
| 5,282,347 | 2/1994 | Cleine et al. | 53/588 X |
| 5,311,725 | 5/1994 | Martin et al. | 53/556 |
| 5,315,809 | 5/1994 | Gordon et al. | 53/399 |
| 5,336,042 | 8/1994 | Winski et al. | 414/789.5 |
| 5,372,472 | 12/1994 | Winski et al. | 414/786 |
| 5,390,476 | 2/1995 | Morantz | 53/556 |
| 5,404,691 | 4/1995 | Scherer | 53/399 |
| 5,423,163 | 6/1995 | Wendt | 53/556 |
| 5,445,493 | 8/1995 | Yourgalite et al. | 414/791.6 |
| 5,517,807 | 5/1996 | Morantz | 53/588 X |

FOREIGN PATENT DOCUMENTS

| | | | |
|---|---|---|---|
| 289784 | 11/1988 | European Pat. Off. | 53/588 |
| 2256708 | 5/1974 | Germany | 53/588 |

*Primary Examiner*—John Sipos
*Attorney, Agent, or Firm*—Finnegan, Henderson, Farabow, Garrett & Dunner, L.L.P.

[57] ABSTRACT

A stretch wrapping machine includes a packaging material dispenser for dispensing packaging material and a segmented wrapping frame for supporting the packaging material dispenser. The frame includes segments of track which are assembled to one another to form a track for the packaging material dispenser so the packaging material dispenser can revolve around the load while rolling on coaxial wheel pairs. A motor drives the packaging dispenser around the load to wrap packaging material around the load.

32 Claims, 24 Drawing Sheets

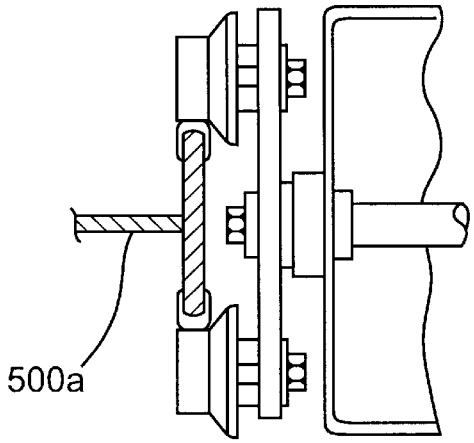
FIG. 14A
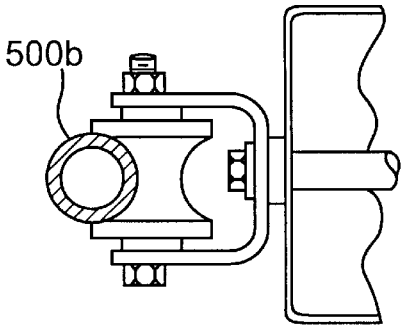
FIG. 14B
FIG. 14C
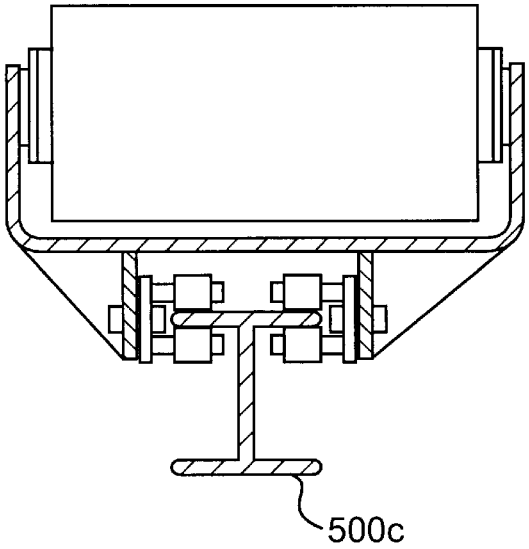
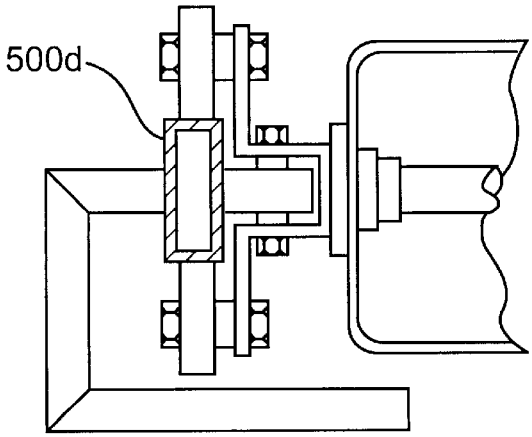
FIG. 14D
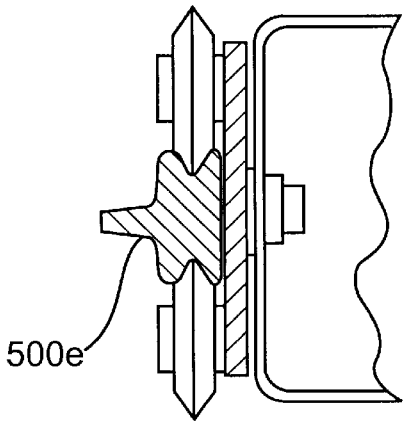
FIG. 14E

WRAPPING APPARATUS AND METHOD

BACKGROUND OF THE INVENTION

1. Field of the Invention

The present invention relates to methods and apparatus for wrapping a load with packaging material, and more particularly, stretch wrapping.

2. Description of the Related Art

Various packaging techniques have been used to build a load of unit products and subsequently wrap them for transportation, storage, containment and stabilization, protection and waterproofing. One popular system uses stretch wrapping machines to stretch, dispense, and wrap stretch packaging material around a load. Such machines may have various semi-automatic and automatic features depending on their application and cost constraints. For example, the dispenser can include a pre-stretch device or be assisted or powered by a motor connected to the stretching portion.

The stretch wrapping machine provides relative rotation between the stretch wrap packaging dispenser and the load either by driving the stretch wrap packaging dispenser around a stationary load or rotating the load on a turntable.

The stretch wrap packaging material dispenser may rotate with a circular ring supported and guided by elements such as wheels, casters, or cam followers, located at various points around the ring and mounted to a main frame which supports the wrapping apparatus. A drive motor and flexible members, such as a belts, chains, or cables, may be used to rotate the ring. Upon rotation, the stretch packaging dispenser wraps packaging material on the load.

Conventional arrangements have limitations and disadvantages including noncomplementary dispenser paths for square or rectangular loads that waste time, space and materials, and limit efficiency and flexibility.

SUMMARY OF THE INVENTION

Accordingly, the present invention is directed to an improved apparatus and method that obviates such limitations and disadvantages.

Additional features and advantages of the present invention will be set forth in the description which follows, and in part will be apparent from the description, or may be learned by practice of the invention. The objectives and advantages of the invention will be realized and attained by means of the elements and combinations particularly pointed out in the appended claims.

To achieve these and other advantages and in accordance with the present invention, as embodied and broadly described herein, an apparatus for wrapping a load is provided.

According to one aspect of the invention the apparatus includes a packaging material dispenser for dispensing stretch wrap packaging material; a segmented wrapping frame for supporting the packaging material dispenser, the frame comprising segments of track which are assembled to one another to form a track for the packaging material dispenser so the packaging material dispenser can revolve around the load; and a motor for driving the packaging dispenser around the load to wrap packaging material around the load.

According to another aspect of the invention, an apparatus is also provided for packaging a load, the apparatus including a packaging material dispenser for dispensing packaging material around a load, the dispenser having a body, a first pair of co-axial wheels having first and second wheels rotatable about a first axis; a wrapping frame for supporting the packaging material dispenser, the frame having a first track, the first track having a first rail for contacting the first wheel of the first pair of co-axial wheels and a second rail for contacting the second wheel of the first pair of co-axial wheels, permitting the packaging material dispenser to travel around the track; and a motor for driving the stretch wrap packaging dispenser around the track to wrap stretch wrap packaging material around the sides of the load.

According to a further aspect of the invention an apparatus is further provided for packaging a load, the apparatus including a packaging material dispenser for dispensing packaging material; a segmented wrapping frame for supporting the packaging material dispenser, the frame having first and second tracks for the packaging material dispenser to travel around; a motor for driving the packaging dispenser around the tracks to wrap packaging material around the load; a flexible connector supported around a perimeter of the track and connected to the packaging material dispenser; and supports for the flexible connector positioned around the perimeter of the track.

According to an even further aspect of the invention, a method of assembling a wrapping apparatus for wrapping a load is provided. The method includes the steps of determining a shape and size of the load to be wrapped; choosing and assembling track segments into tracks resembling the shape and size of the load to be wrapped; providing a packaging material dispenser on the tracks; and providing means for moving the packaging material dispenser around the tracks.

According to another aspect of the invention, a method of wrapping a load is also provided. The method includes the steps of determining a shape and size of a load to be wrapped; determining whether the shape and size of a wrapping frame is desirable for the shape and size of the load; automatically changing the shape and size of the wrapping frame to improve the desirability of shape and size of the wrapping frame relation to the shape and size of the load; and driving a packaging material dispensing around the frame to wrap packaging material around the load.

It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate several embodiments of the invention and together with the description, serve to explain the principles of the invention.

FIGS. 10A–10E is an embodiment of a wrapping frame of the present invention in use;

FIGS. 14A–14E are views showing different embodiments of the types of tracks which can be used with the present invention;

DESCRIPTION OF THE PREFERRED EMBODIMENTS

Figure 1:
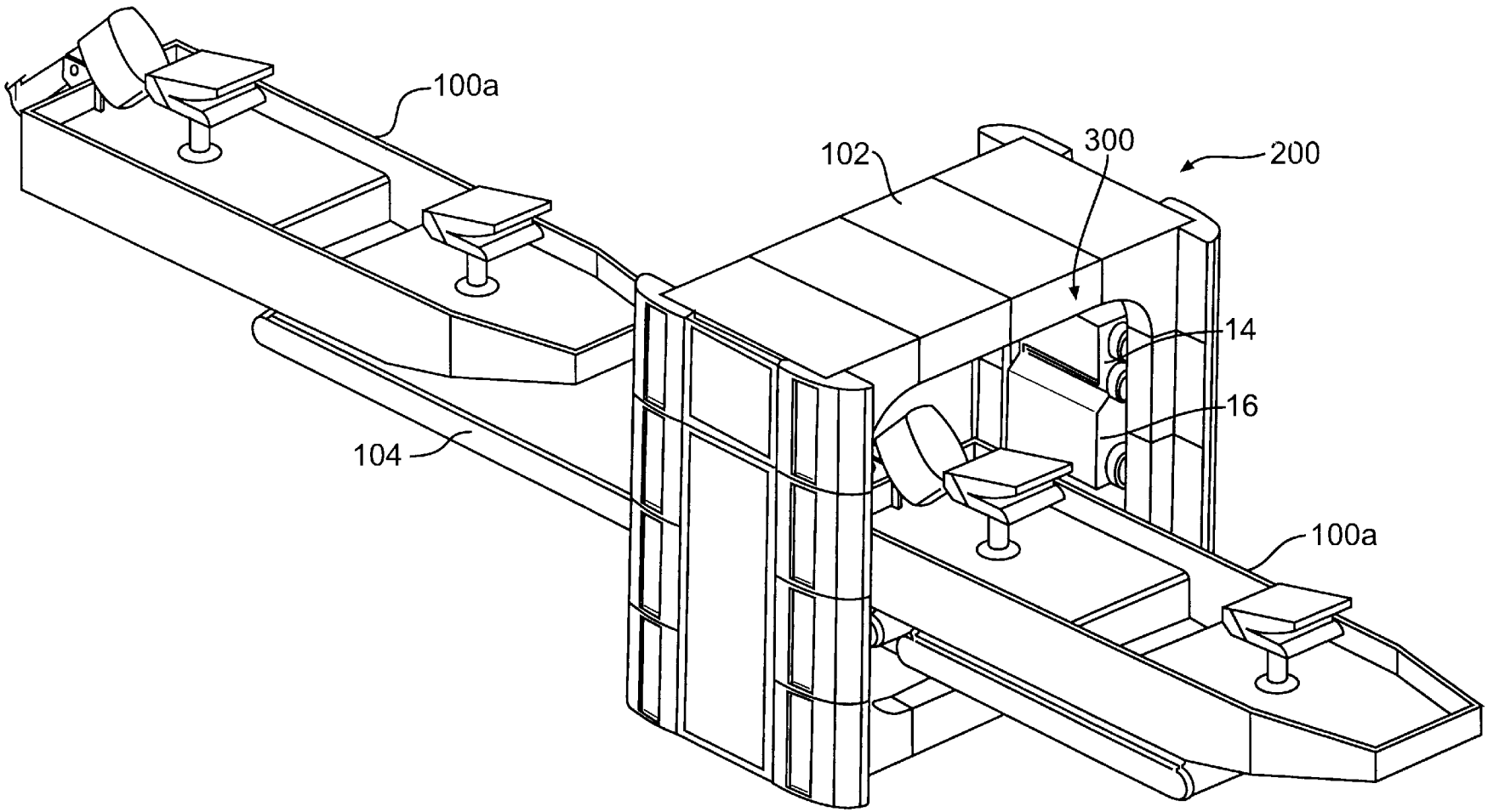
FIG. 1 is an isometric view of an embodiment of a wrapping apparatus according to the present invention.

Reference will now be made in detail to the present preferred embodiments of the invention, examples of which are illustrated in the accompanying drawings. Wherever possible, the same reference numbers will be used throughout the drawings to refer to the same or like parts.

The present invention relates to an apparatus and method for stretch wrapping loads. According to one aspect of the present invention, the apparatus includes a segmented wrapping frame, a film dispenser, and a drive mechanism. The film dispenser dispenses film stretch material that wraps around the load. The drive mechanism drives the film dispenser around the wrapping frame.

According to another aspect of the present invention, the segmented wrapping frame has a non-circular configuration and has a front and rear portion, each portion forming a track within the wrapping frame. The front and rear portions are connected to one another by supports such that the two tracks together generally form a guiding system for the film dispenser and the drive mechanism. Each track has an inner upper rail and an inner lower rails which guide the film dispenser around the tracks to wrap the load.

This segmented non-circular wrapping frame requires a smaller support framework than a circular ring, and less floor space. In addition, the segments permit the shape and size of the wrapping frame to accommodate differently sized and shaped loads without requiring a new or specialized machine for each load. Also, because the wrapping frame can closely approximate the size and shape of the load being wrapped, the film dispenser has less distance to travel around the wrapping frame than if a conventional round ring was used, therefore decreasing packaging time and increasing output and efficiency.

According to another aspect of the invention, the film dispenser mechanism that rides or is guided by the rails of the tracks around the segmented wrapping frame may include a roll of stretch packaging material and pre-stretch rollers, and is mounted on axles having pairs of coaxial wheels at each end. Each pair of wheels has a wheel which rides in the first rail of the tracks and a second wheel which rides in the second rail of the tracks, to allow the film dispenser to move smoothly around the tracks.

As mentioned, the film dispenser is driven by the drive mechanism. In a first embodiment of the drive mechanism, a motor car includes a motor and wheels which ride in the tracks of the wrapping frame. A flexible connector is supported around the tracks and connects the film dispenser and the motor car for movement of the film dispenser. The flexible connector is attached to the cars such that it is level with the center of the axles and thus the height at which the flexible connector is located does not change and there is no change in tension in the flexible connector as the film dispenser and motor car travel around the tracks. The motor powers the motor car which moves the flexible connector and the film dispenser. The film dispenser and the motor car may be spaced such that they are located opposite each other on the tracks. In this way, the motor car acts as a counterbalancing weight for the film dispenser. Alternatively, the film dispenser and the motor car may be proximate and directly attached to one another. As a further alternative, the film dispenser may contain a motor to power itself around the tracks.

In a second embodiment of the drive mechanism, an outside drive has a flexible connector similar to that of the first embodiment, a motor, and a drive belt. The drive belt lies on top of and contacts the flexible connector. In operation, the motor drives the drive belt which moves the flexible connector and the film dispenser.

Figure 2:
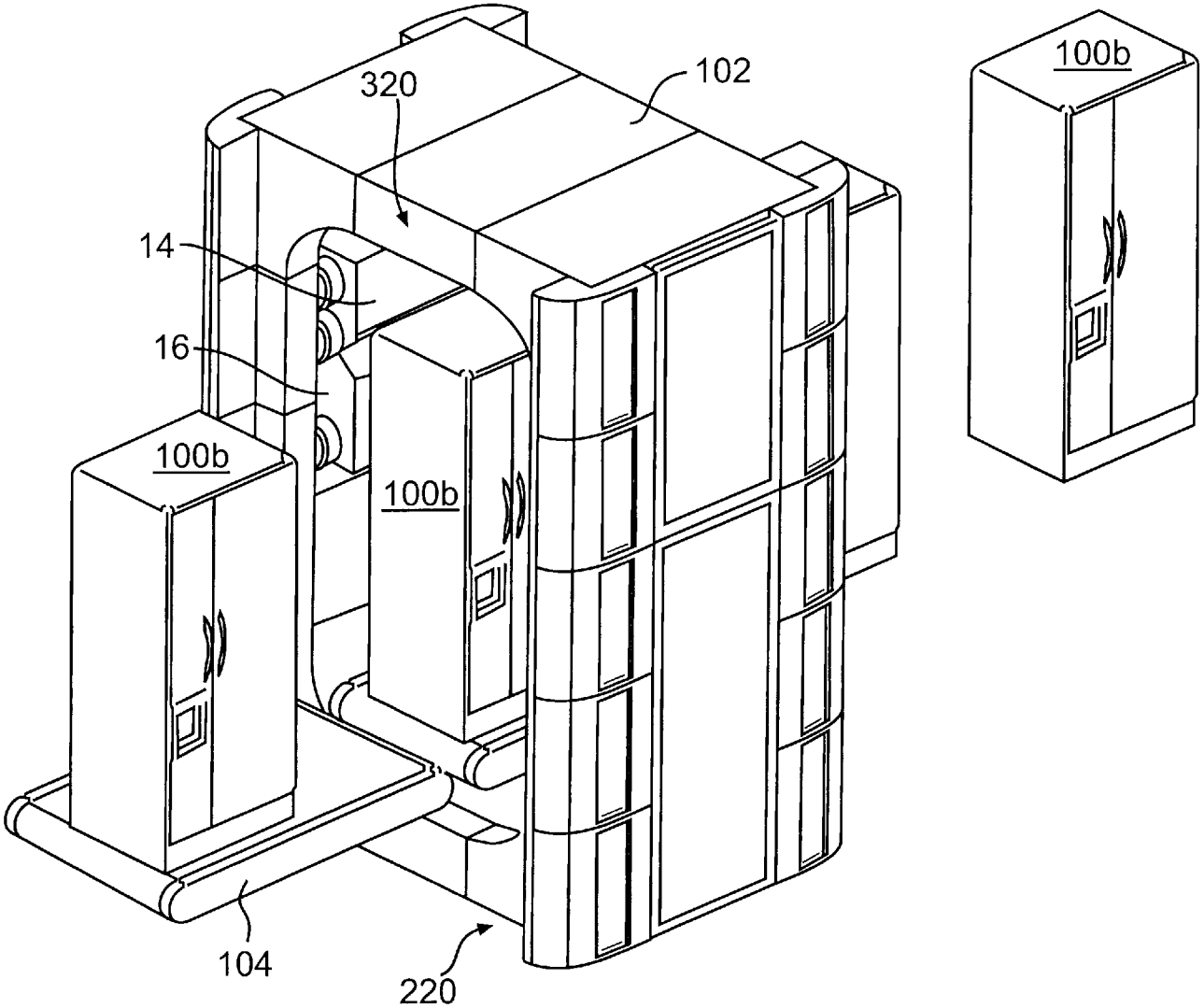
FIG. 2 is an isometric view of a second embodiment of a wrapping apparatus according to the present invention.
Figure 3:
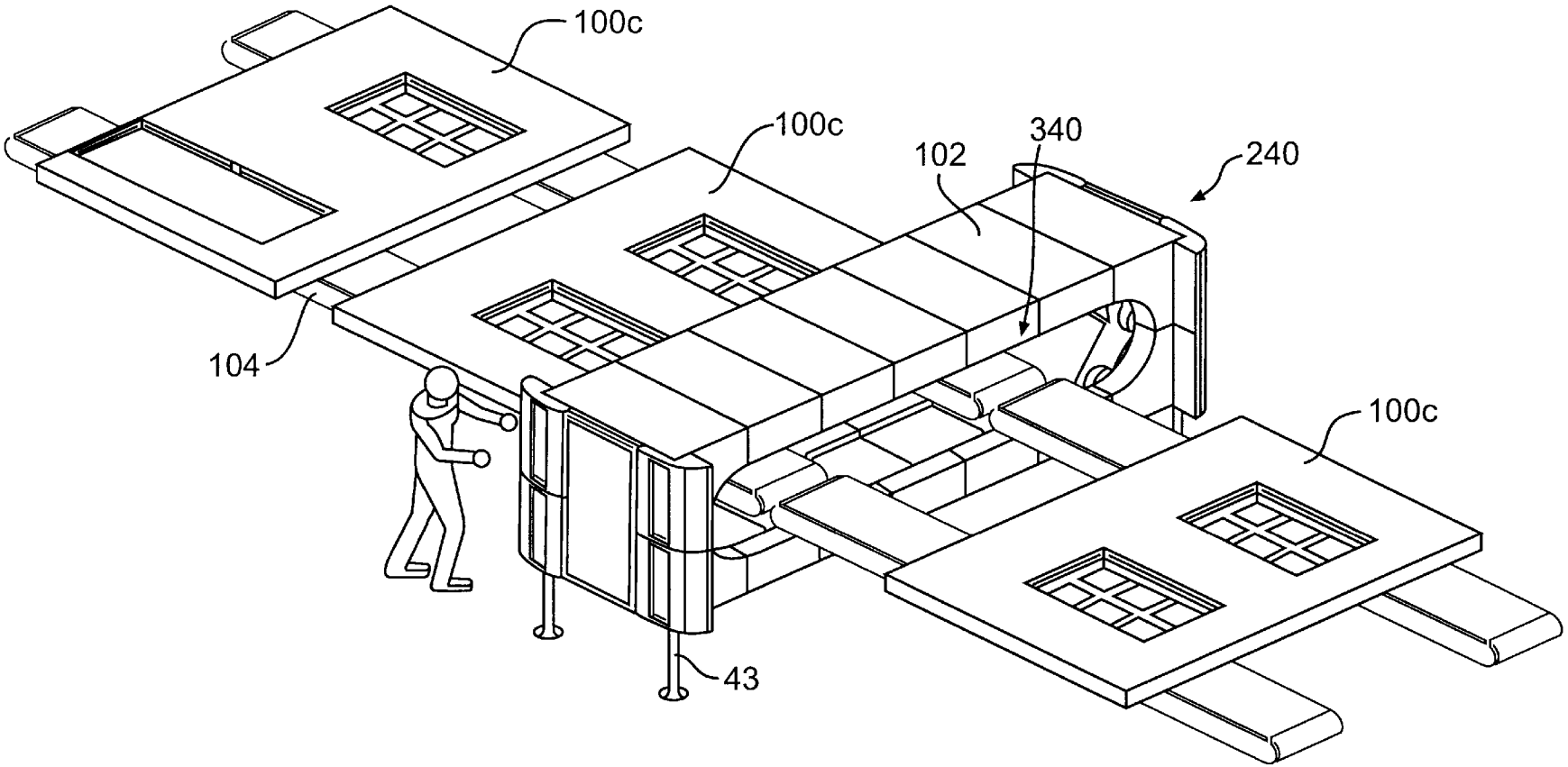
FIG. 3 is an isometric view of a third embodiment of a wrapping apparatus according to the present invention.
Figure 4:
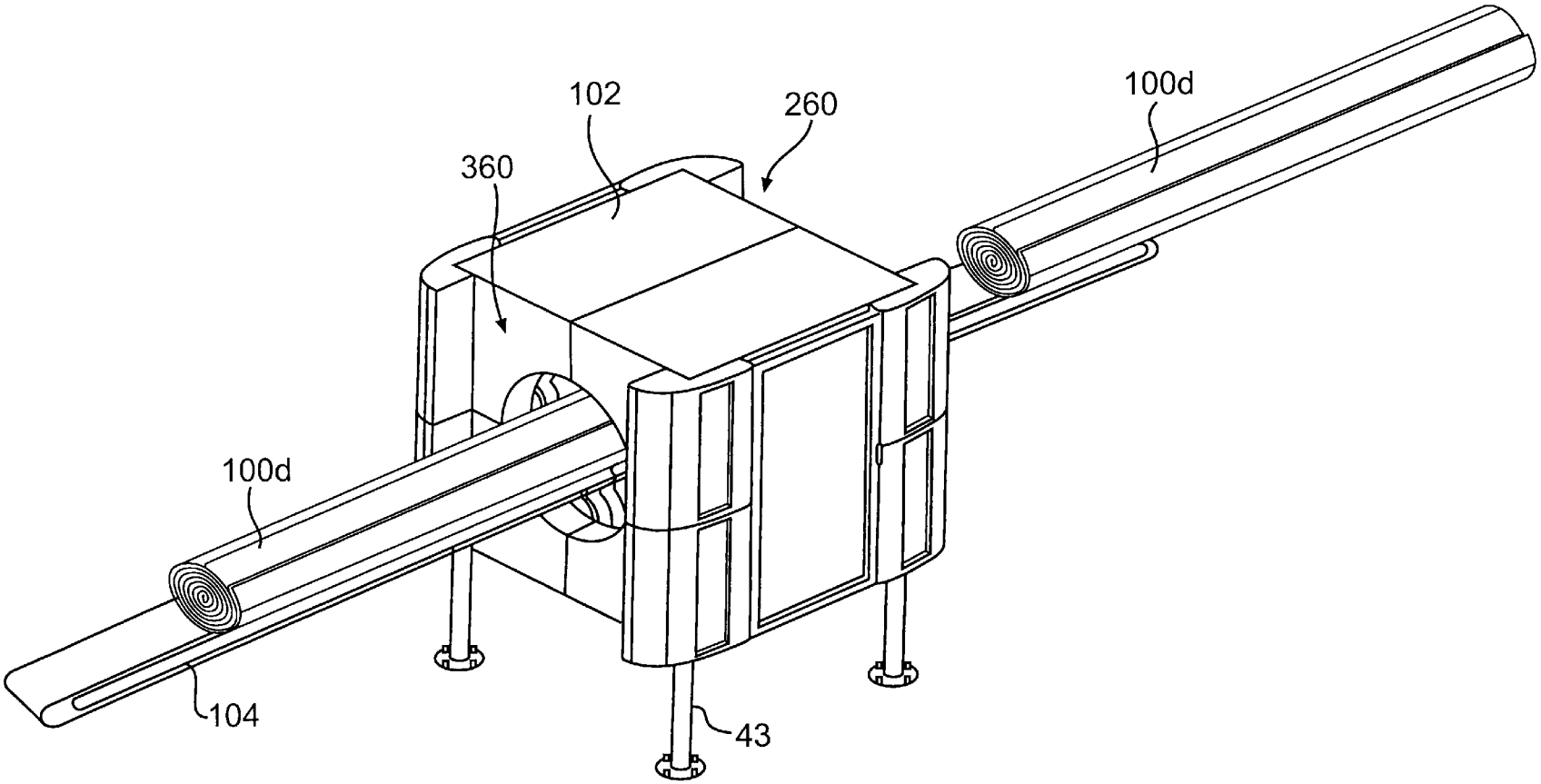
FIG. 4 is an isometric view of a fourth embodiment of a wrapping apparatus according to the present invention.

FIGS. 1–4 generally show various sizes and shapes of loads and corresponding stretch wrapping apparatuses according to the present invention. As is evident from loads 100 being conveyed on a conveyor 104 through the apparatuses (for example, boats, refrigerators, prefabricated portions of housing, and carpets), stretch wrapping apparatuses according to the invention have the ability to efficiently wrap any size or shape load. The stretch wrapping apparatuses of FIGS. 1 to 4 are designated generally by reference numerals 200, 220, 240, and 260. These apparatuses include frames 300, 320, 340, and 360 respectively that each support film dispenser 14 and a drive mechanism 16. Film dispenser 14 dispenses stretch wrap material around a load, and drive mechanism 16 drives film dispenser 14 around the frame. In FIG. 2 embodiment, wrapping frame 300 is square in form and in the FIG. 2 embodiment wrapping frame 320 is an oblong rectangle in form. The FIG. 3 wrapping frame 340 has the form of an oblong slot, and the FIG. 4 frame 360 is circular. As seen in these figures, the wrapping frames are covered by panels 102 that snap on and off of the wrapping frames, and are interchangeable so that they may be used on any size wrapping frame.

The wrapping frames according to the present invention may be positioned as seen in FIGS. 1–4, such that film dispenser 14 travels around the wrapping frame while load 100 travels through the wrapping frame. Alternatively, as shown in FIG. 10, wrapping frames may be mounted on vertical risers 106 and positioned such that film dispenser 14 travels around the wrapping frame while the wrapping frame moves vertically along vertical risers 106 to encompass an incoming load 100. Wrapping frames according to the present invention also may be positioned at any angle so as to receive and wrap loads being fed at any angle.

Figure 5:
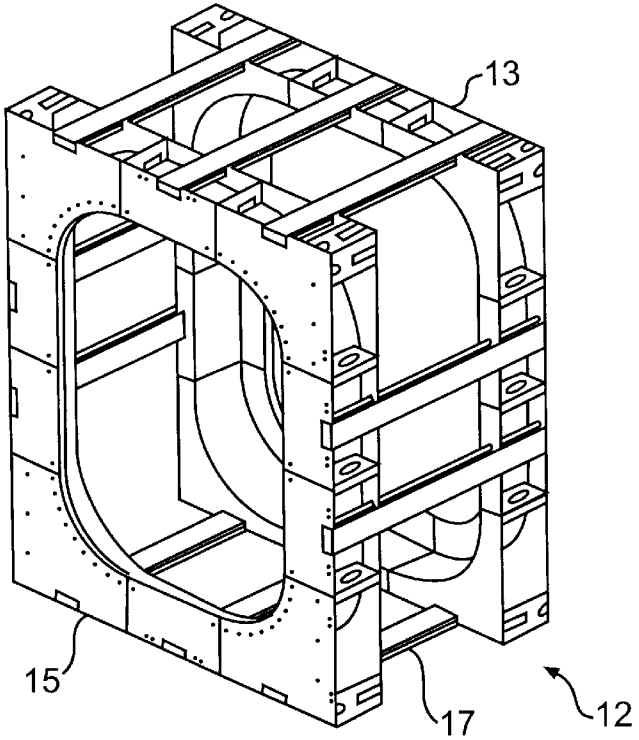
FIG. 5 is an isometric view of an embodiment of a wrapping frame according to the present invention.

In accordance with the present invention, FIG. 5 shows an embodiment of a wrapping frame 12 for a film dispenser and drive mechanism. Frame 12 includes a front portion 13, a rear portion 15, and cross member supports 17. Front portion 13 and rear portion 15 include riveted or bolted segments secured to one another by cross member supports 17. Supports 17 may be made of any suitable material, for example, steel tubular supports, that provide sufficient strength and rigidity to wrapping frame 12.

Figure 11:
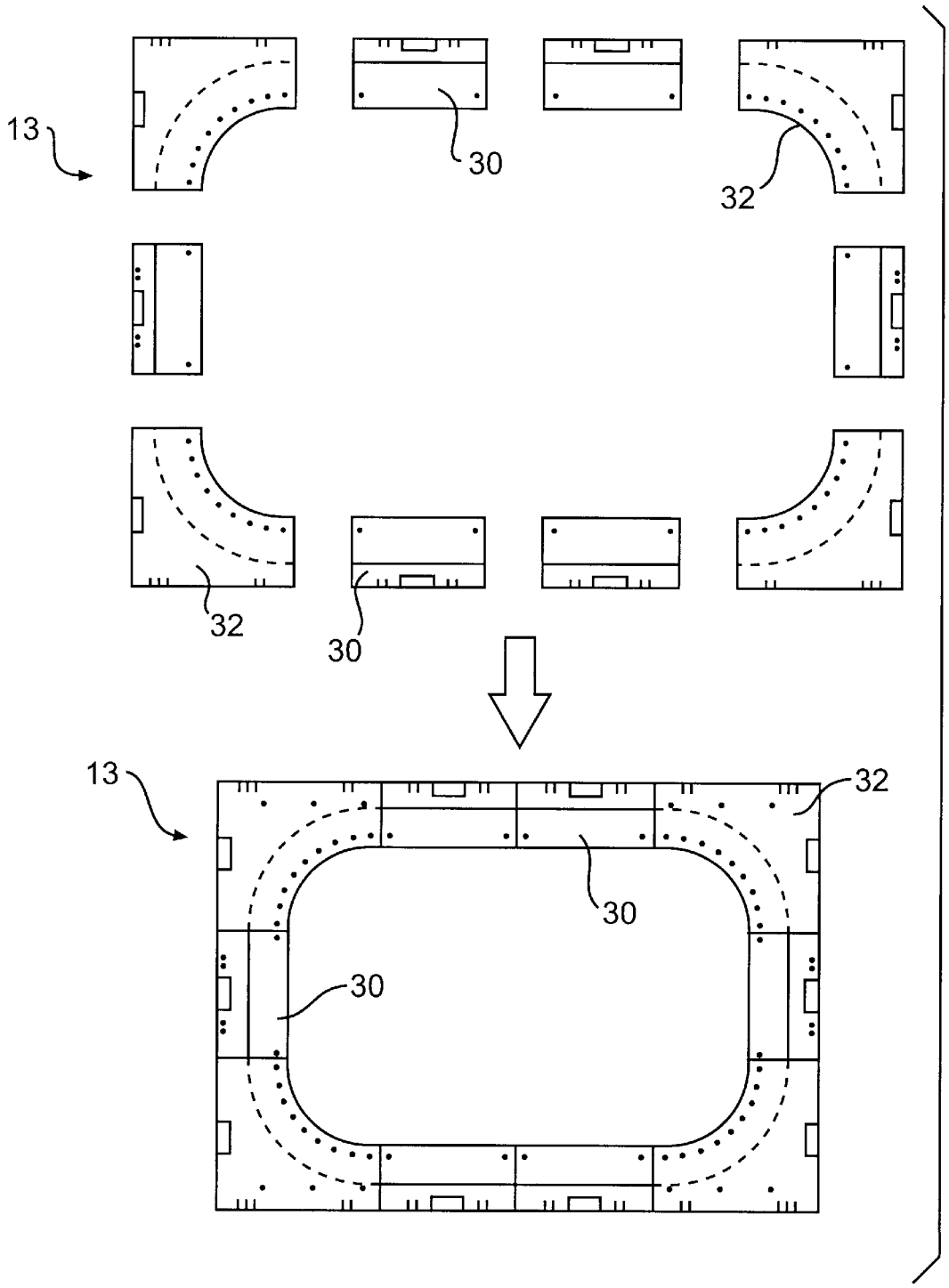
FIG. 11 is a cross-sectional view of the wrapping frame of FIG. 5.

As mentioned earlier, the shape and size of frame 12 may be chosen based upon the type, size, or shape of the load to be stretch wrapped. The shape and size of frame 12 is determined by the number and type of track segments used to make up frame 12. As best seen in FIG. 11, front portion 13, and rear portion 15, comprise various interconnected straight track segments 30 and curved track segments 32. These track segments 30, 32 can be arranged in any number and manner to form wrapping frames of a desired shape.

FIGS. 9A to 9E show additional possible shapes of wrapping frames according to the present invention, generally denoted by reference numerals 320, 340, 360, 380, and 400 respectively. Wrapping frame 320 includes four curved segments 32 to form a circular frame. Wrapping frame 340 of FIG. 9B includes alternating curved segments 32 and straight segments 30 to form a triangular shaped frame.

Figure 9A:
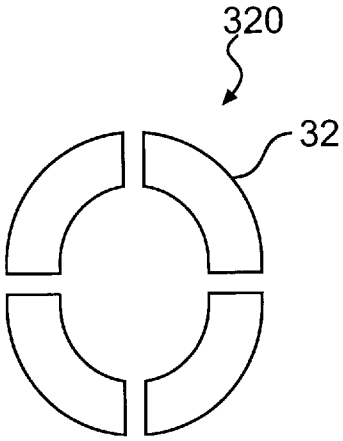
Figure 9B:
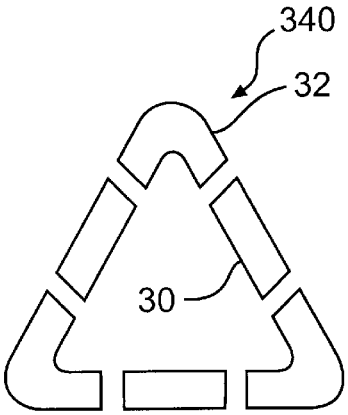
Figure 9C:
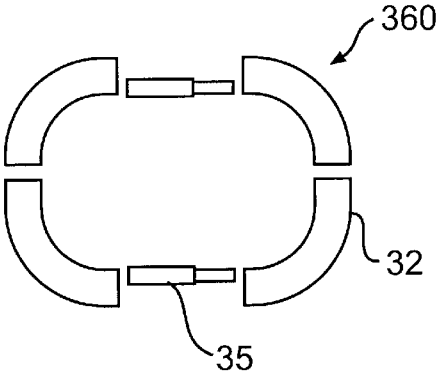
Figure 9D:
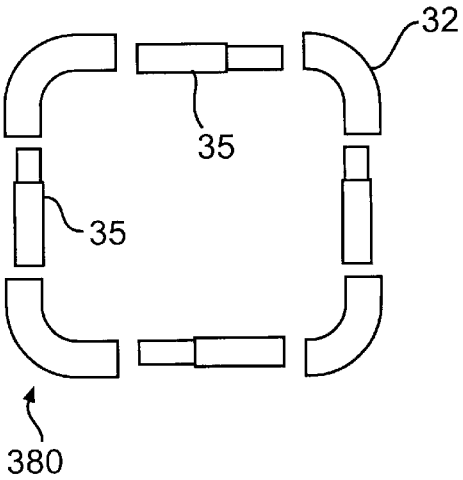
Figure 9E:
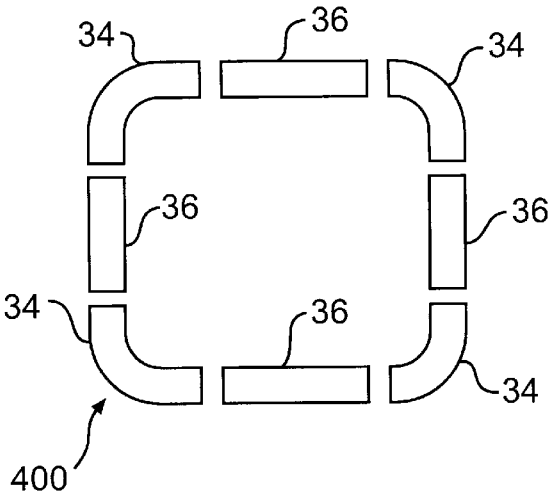
Figure 10A:
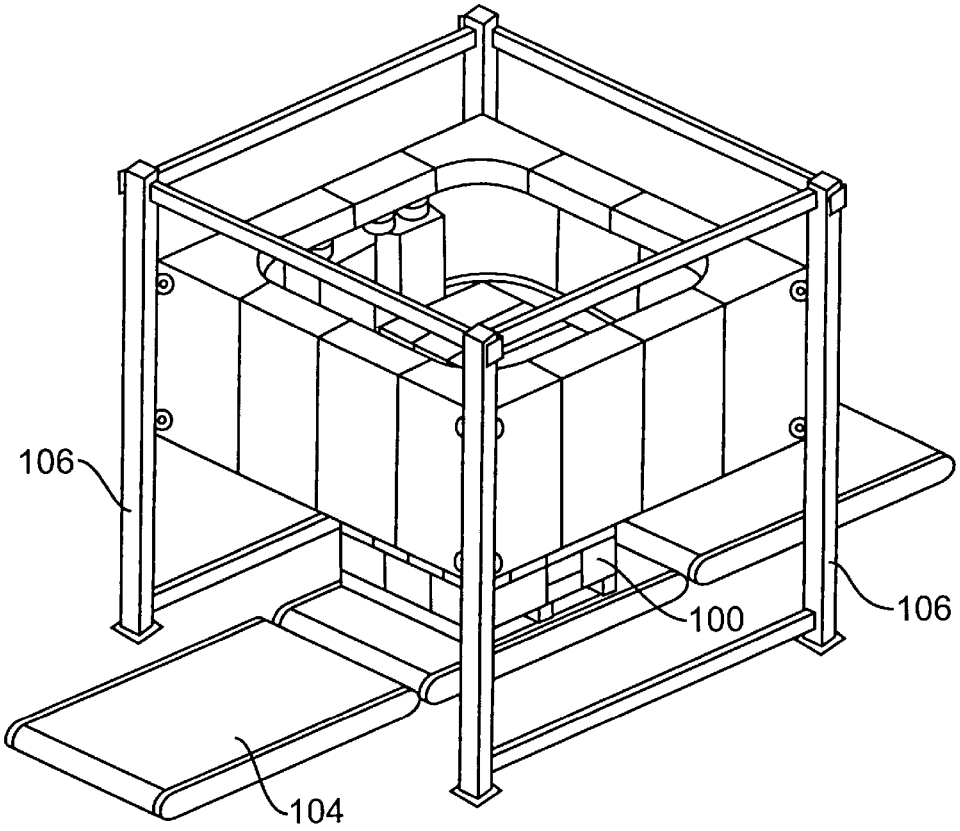
Figure 10B:
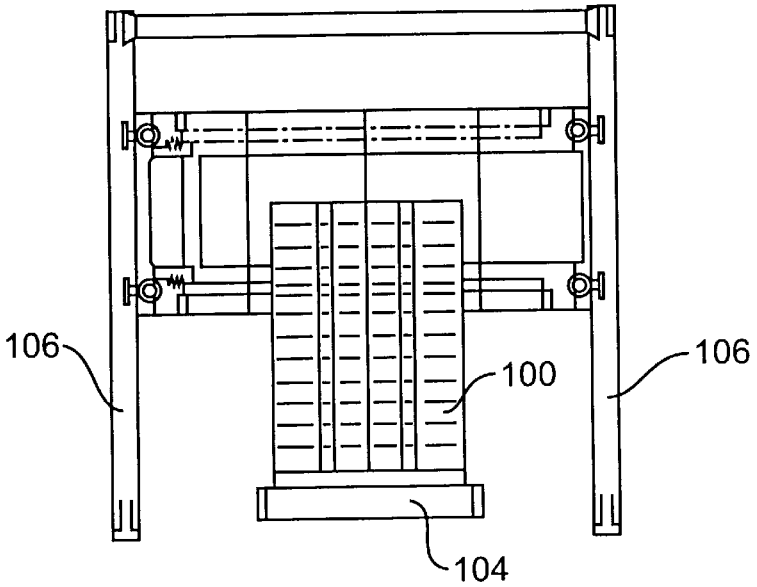
Figure 10C:
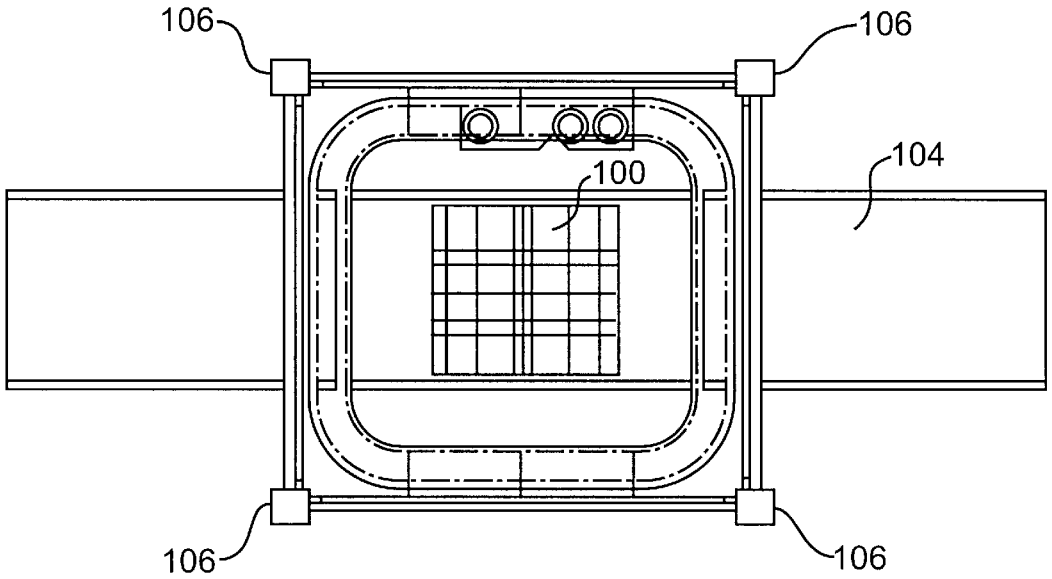
Figure 10D:
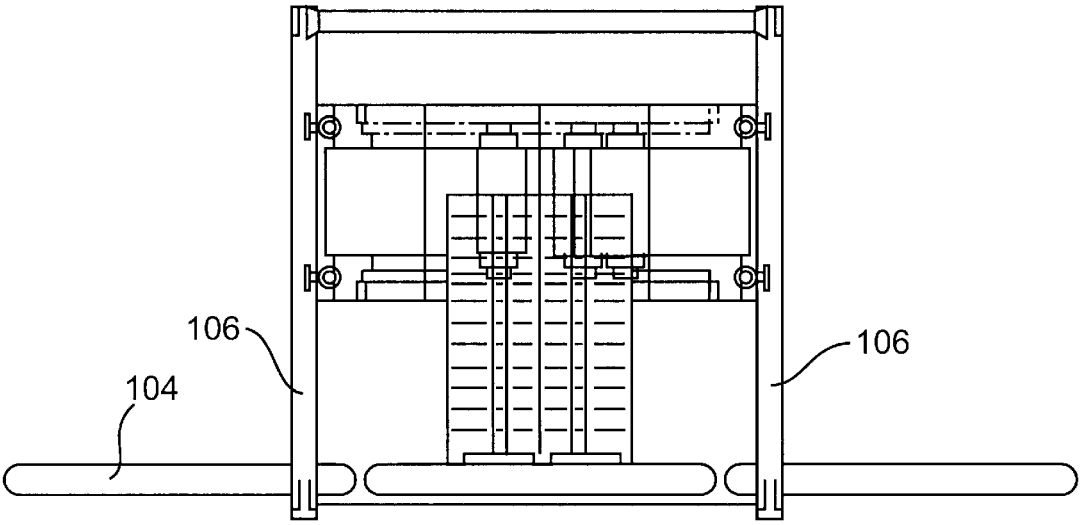

In the alternative to track segments of a fixed length, track segments may telescope or unfold to facilitate changes in the size of a wrapping frame. For example, as shown in FIGS. 9C and 9D, wrapping frames 360 and 380 incorporate curved segments 32 having telescoping portions 35 that telescope from the arrangement of FIG. 9A to alter the size of the wrapping frame. Wrapping frame 400, shown in FIG. 9E, includes four identical corner segments 34, and four identical side segments 36. Having identical segments increases manufacturing ease and interchangeability of parts.

Figure 6:
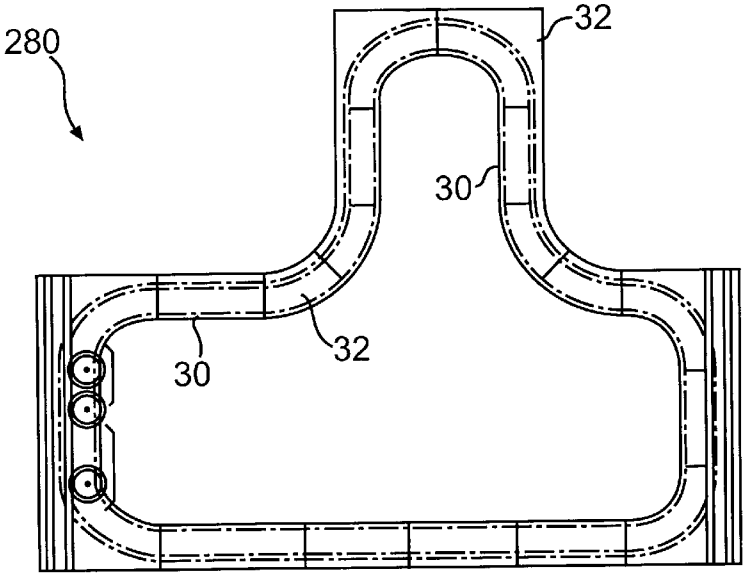
FIGS. 6, 7, 8A–8B & 9A–9E are cross-sectional views of other embodiments of wrapping frames according to the present invention.
Figure 8A:
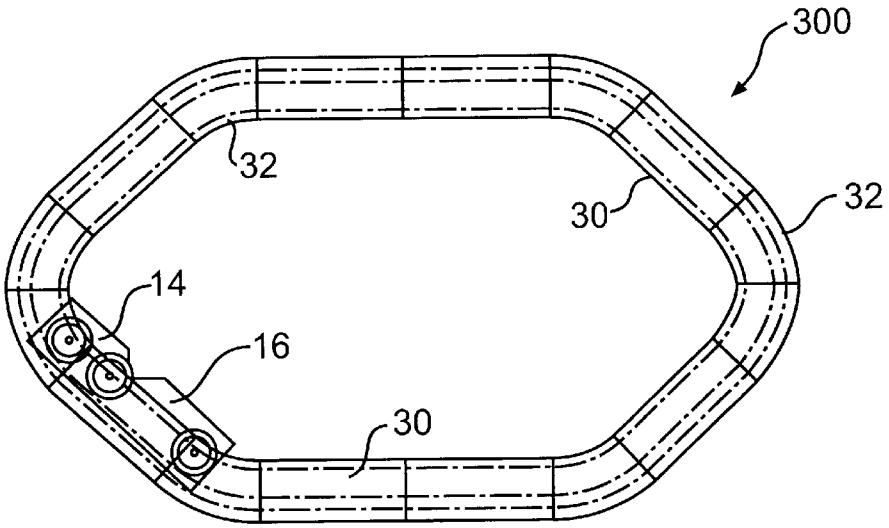
Figure 7:
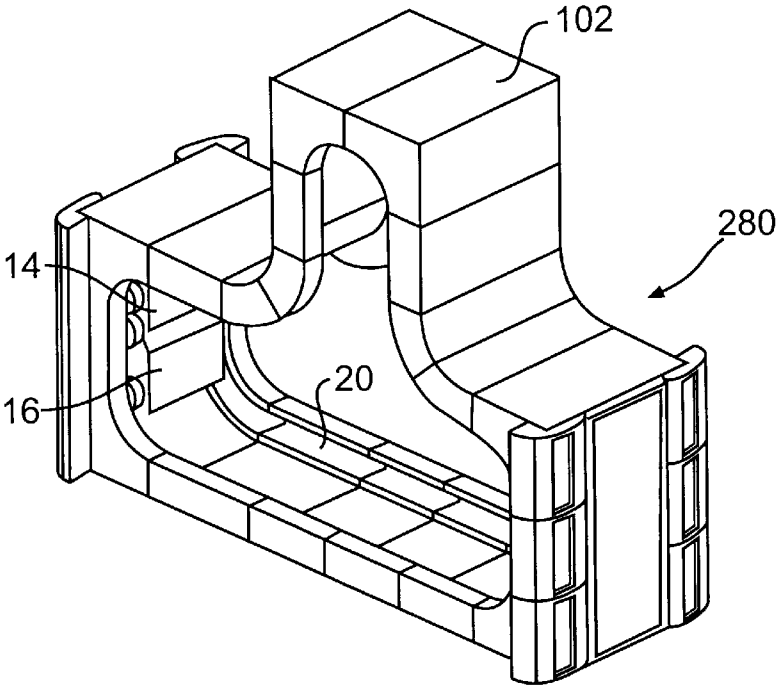
Figure 8B:
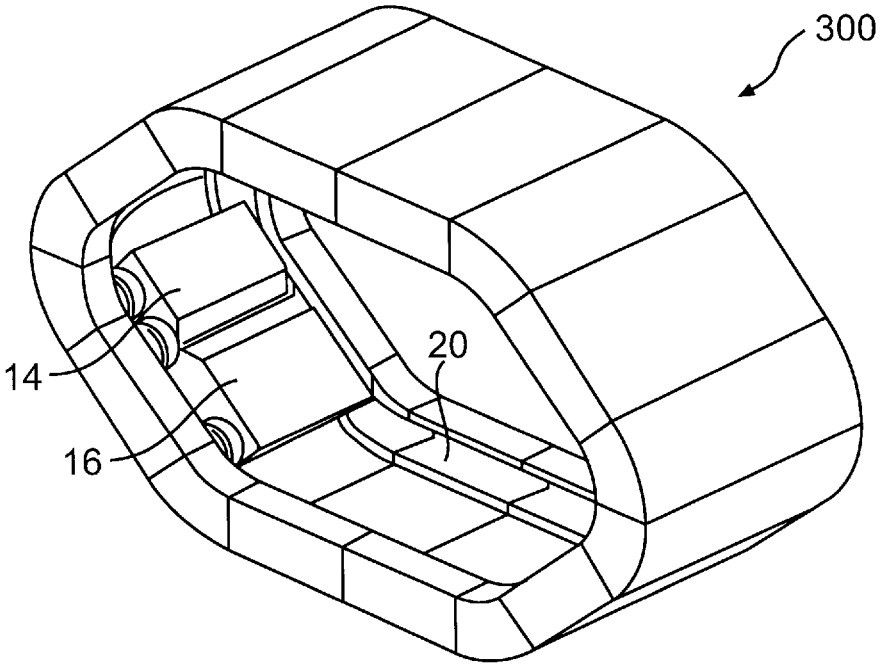

It is to be understood that in addition to being made in variable lengths, the segments may be made in various lengths and the curved segments may be made in various curvatures according to the desired shape and size of the wrapping frame. FIGS. 6–8 show two embodiments of wrapping frames incorporating straight and curved segments of varying lengths and degrees of curvature. A wrapping frame 280 of irregular shape is shown in FIGS. 6 and 7, and a wrapping frame 300 also of irregular shape is shown in FIGS. 8A and 8B. Such frame shapes may be constructed of a number of identical single size straight pieces and a number of identical single size curved pieces.

Alternatively, wrapping frame 12 may automatically change size, for example from 9A to 9C to 9D, while segments 30, 32 are assembled by using mechanisms such as a rack and pinion, or pneumatic drives directed by a controller, microprocessing software, or electromechanical connections which would enable an in-line change of frame shape and size in response to optically or mechanically sensing the shape and/or size of an incoming load.

Alternatively, the frame size and shape can be altered for new load streams by assembling more or less segments or changing the arrangement of the segments. Besides altering the general shape of a wrapping frame according to the present invention, the width of a frame also may be altered by changing the length of cross member supports 17. Cross member supports 17 may be of a fixed length and interchangeable with supports of different lengths. Alternatively, supports 17 may be of a variable length in the form of telescoping or folding supports so that the supports do not have to be interchanged when a change in width of the frame is required.

Figure 12:
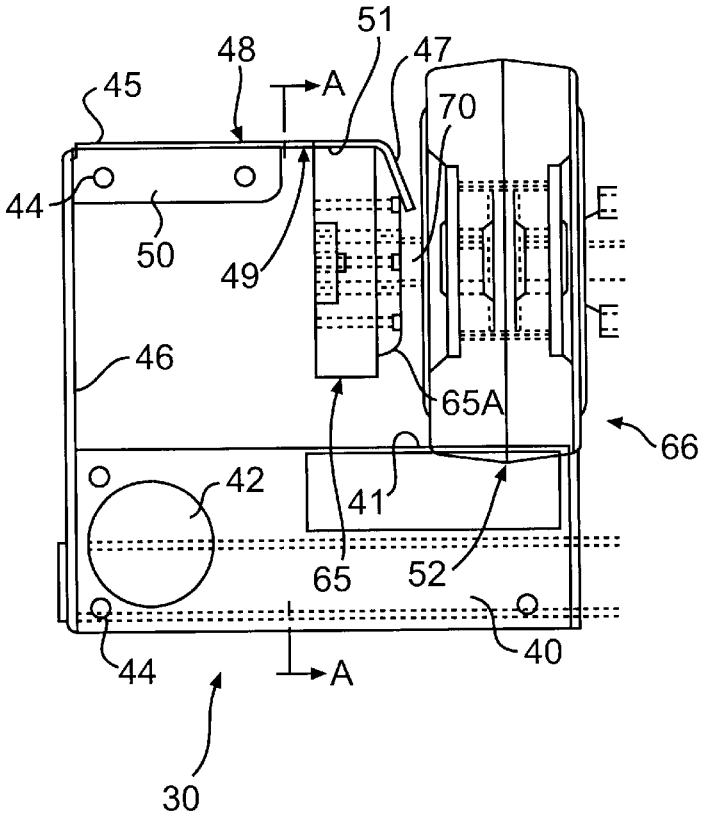
FIG. 12 is a partial view of a cross-section of a wrapping frame with a pair of co-axial wheels located on a track of the wrapping frame of the present invention.

Once a plurality of segments have been secured together to form front and rear portions 13, 15, and these portions 13, 15 are secured to one another, tracks 20 are formed within the wrapping frame, one track in each portion 13, 15, as shown in FIG. 7. The tracks form a guiding system around which film dispenser 14 and drive mechanism 16 travel. As shown in FIG. 12, each track 20 has an inner upper rail 24 and an inner lower rail 26, where wheel 65 rides rail 51 and wheel 66 rides rail 52. The rails guide film dispenser mechanism 14 around tracks 20 to wrap a load 100.

The track segments are preferably made from a material of appropriate strength and rigidity, for example, sheet steel, cast aluminum, or plastic. As shown in FIG. 12, a track segment 30 includes a base 40, a corner portion 45, and a connecting area 50 for connecting track segments 30 together. Base 40 includes an upper surface 41, and an opening 42 for inserting legs 43 (see FIGS. 3 and 4) if it is desired to raise the wrapping frame off the ground. Base 40 also includes small holes 44 for bolting track segments 30 together. Connecting area 50, which extends from corner portion 45 in the form of a flange or tab to FIG. 12, also includes holes 44 for bolting track segments 30 together. It is to be understood that track segments may be permanently joined by methods such as welding or riveting, or releasably joined by methods such as clamping or bolting.

With further references, corner portion 45 includes a side section 46 connected to base 40, and a top piece 48 with an inner surface 49 connected to side section 46. Together, side section 46 and top piece 48 form a "J" shape. Corner portion 45 has a flange 47 which acts to secure film dispenser 14 on tracks 20. Flange 47 may be integral with or separately attached to corner portion 45 and, preferably, is a disc comprised of nylon or other suitable synthetic material. Corner portion 45 and base 40 may be formed integrally, or corner portion 45 may take the form of a cap which snaps onto base 40. When these track segments 30 just described are joined together to form a frame, inner surfaces 49 of top pieces 48 and top surfaces 41 of bases 40 form first and second rails 51, 52, respectively, of tracks 20 upon which film dispenser 60 and drive mechanism 16 ride.

Alternatively, and as embodied in FIGS. 14A–14E, other forms of tracks may be provided within wrapping frame 12. FIG. 14A shows a "T-type" of track or guiding rail 500*a*. FIG. 14B shows a circular track 500*b* which may be a rail, tubing or other material suitable for supporting the film dispensing mechanism. FIG. 14C shows an "I" or "H" type configuration 500*c* for use as a track or guiding rail. FIGS. 14D and 14E show yet more embodiments 500*d* and 500*e* of configurations for use as a track or guiding rail in the present invention.

Figure 13:
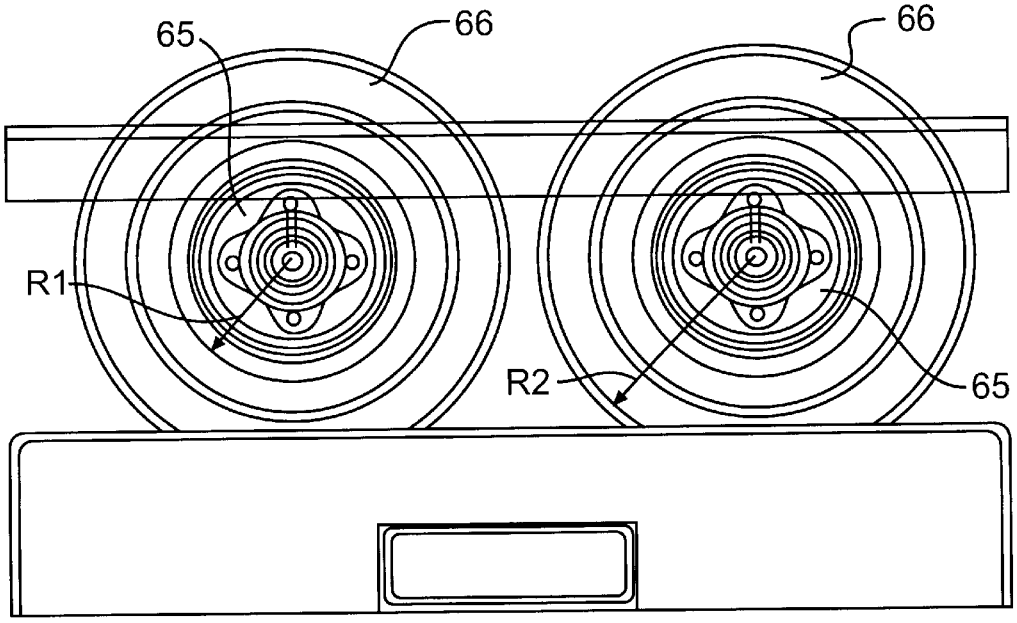
FIG. 13 is a partial view of the co-axial wheels of FIG. 12 taken in the direction of line A—A of FIG. 12.
Figure 15:
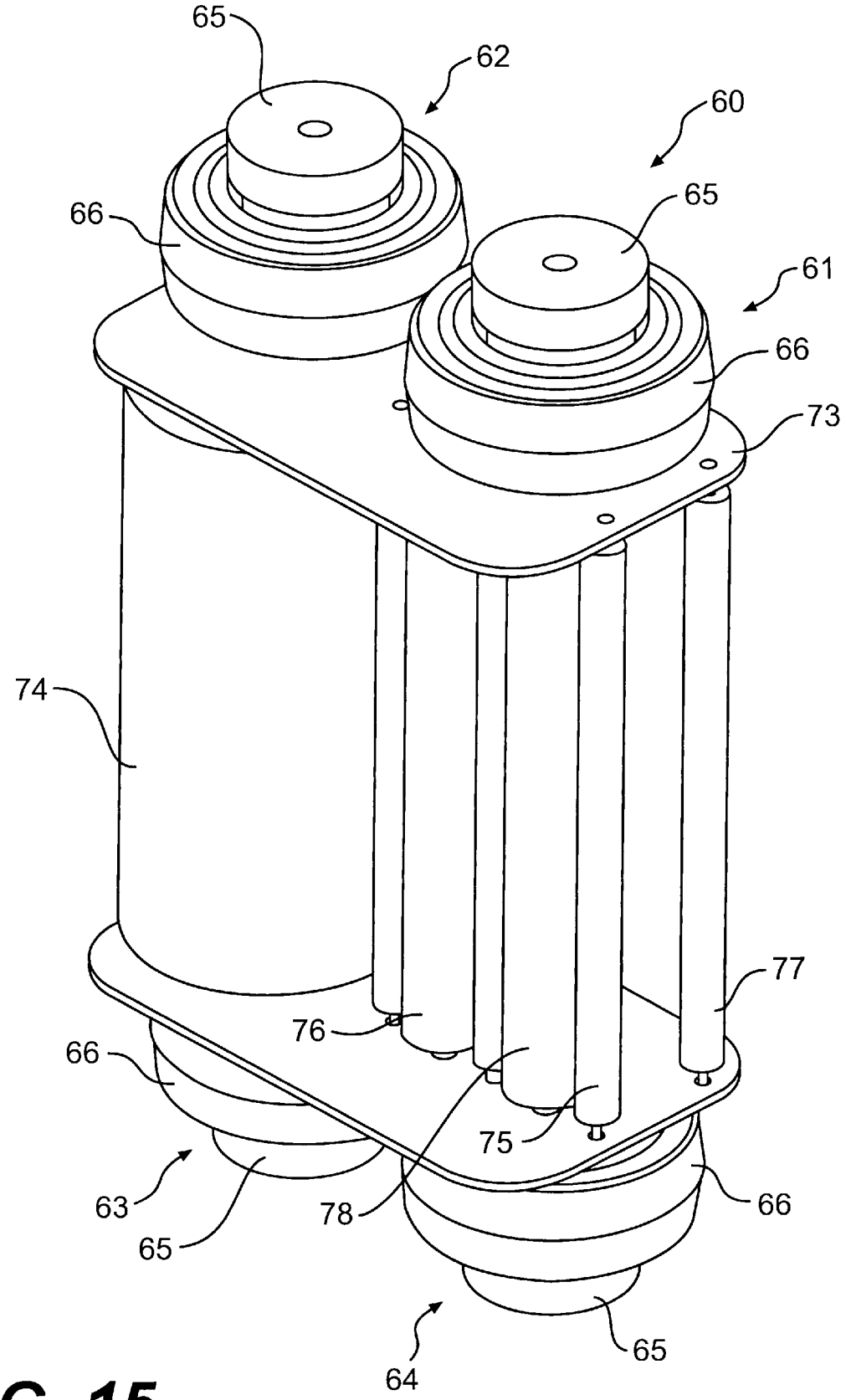
FIG. 15 is an isometric view of a film dispenser of the present invention.

The film dispenser that rides on rails 51, 52 of tracks 20 includes several pairs of co-axial wheels, and a dispenser housing. As shown in FIGS. 12, 13 and 15, and according to an aspect of the invention, a film dispenser mechanism 60 includes four pairs of co-axial wheels 61, 62, 63, 64, each pair having a first outer wheel 65 and a second inner wheel 66. In this embodiment, first wheel 65 has a width less than that of second wheel 66, and a radius $R_1$ less than a radius $R_2$ of second wheel 66. First wheel 65 may be a urethane or nylon tire used for guiding film dispenser 60 around the wrapping frame. First wheel 65 rides on rail 51 of track 20 such that it contacts inner surface 49 of top piece 48. Flange 47 is located between first and second wheels 65, 66 to prevent the inward movement of side 65*a* of wheel 65 along its axis. In this way, first wheel 65 prevents side-to-side motion of film dispenser 60.

Second wheel 66 is preferably a pneumatic tire which rides on rail 52 of track 20 such that it contacts top surface 41 of base 40. Once inflated, pneumatic wheel 66 pushes against flange 47 to force flange 47 toward wheel 65 and locks wheel 65 into place.

Figure 16A:
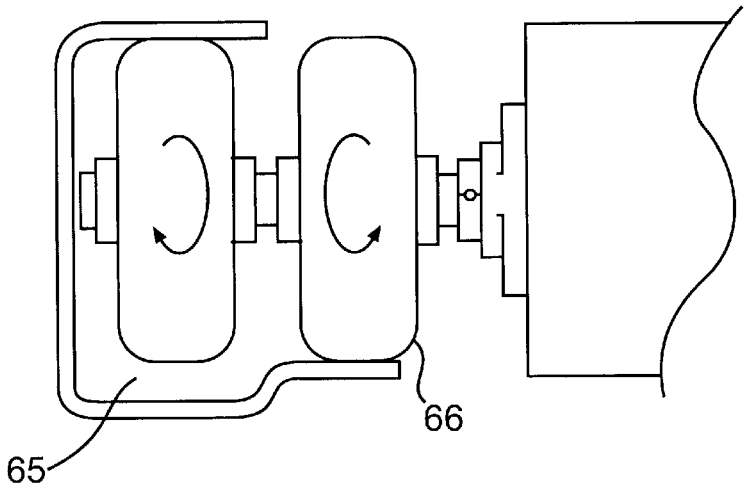
FIGS. 16A–16C are cross-sectional views of various embodiments of a co-axial wheel pair and corresponding rail profiles of the present invention.
Figure 16B:
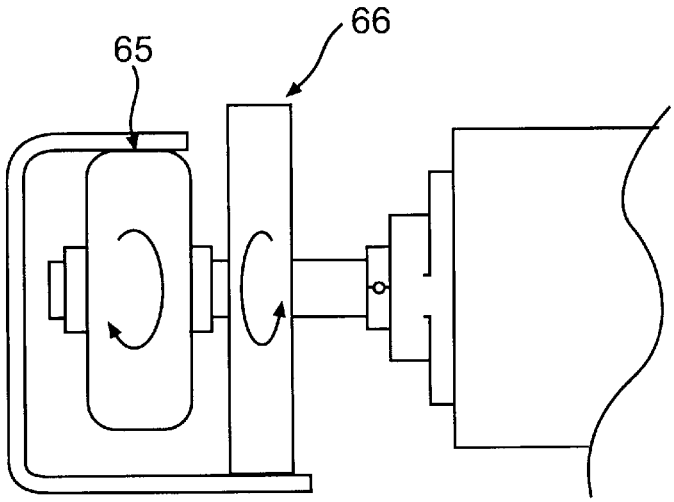
Figure 16C:
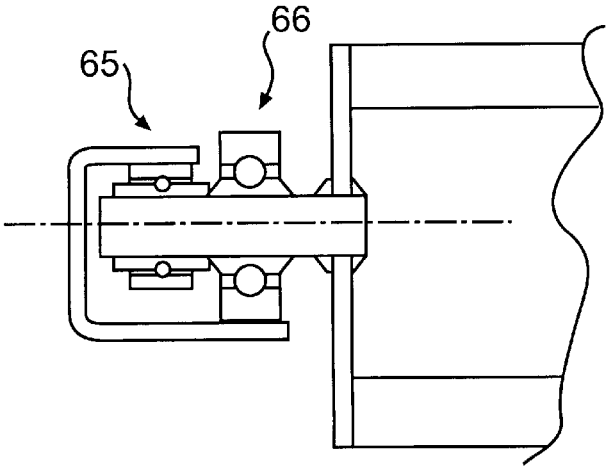

As alternative to wheels 65, 66 just described, FIGS. 16 show first and second wheels 65, 66 of the same width and radius (FIG. 16A), or a first wheel 65 of larger width than second wheel 66 (FIG. 16B). In FIG. 16A, first and second wheels 65, 66 are of similar construction, either pneumatic, rubber, or other suitable construction, and rotate in opposite directions. In FIG. 16B, wheel 65 is shown as a rubber, pneumatic, type or otherwise deformable material, and wheel 66 is shown as a hard, non-deformable material. It is to be understood by one skilled in the art that various materials, types, and constructions of wheels 65, 66 may be used within the spirit and scope of the invention. For example, FIG. 16C shows wheels 65, 66 reduced to bearings or cam followers arranged to provide the same rotational and load bearing characteristics as pneumatic, rubber, or other types of wheels. Furthermore, the wheels used for the film dispenser or drive mechanism 16 may have a coating or surface to promote compliance and or quietness.

It is also to be understood by one skilled in the art that it will be necessary to change the track configuration to accommodate any change in the wheel sizes, as exemplified in the embodiments shown in FIGS. 16A–16C.

With reference once again to FIG. 12, a pair of first and second wheels 65, 66 is mounted on each end of an axle 70. Film dispenser 60 includes two axles 70 in which a total of four pairs of wheels 65, 66 are mounted. Film dispenser 60 is also mounted on axles 70, which may be one piece and span the width of the wrapping frame, telescope to change length, or separate individual axles for each of the four pairs of wheels. In operation, pairs 61, 62, 63, 64 of co-axial wheels 65, 66 provide movement of film dispenser 60 around tracks 20 of the wrapping frame. Each first wheel 65 rotates in a direction opposite to a direction that second wheel 66 is rotating.

As shown in FIG. 15, an exemplary film dispenser 60 includes a roll of stretch film 74, idler rollers 75 and 77, body 73 and pre-stretch rollers 76 and 78 which stretch the stretch film 74 before dispensing. Film dispenser 60 may take forms other than that shown in FIG. 15.

Figure 18:
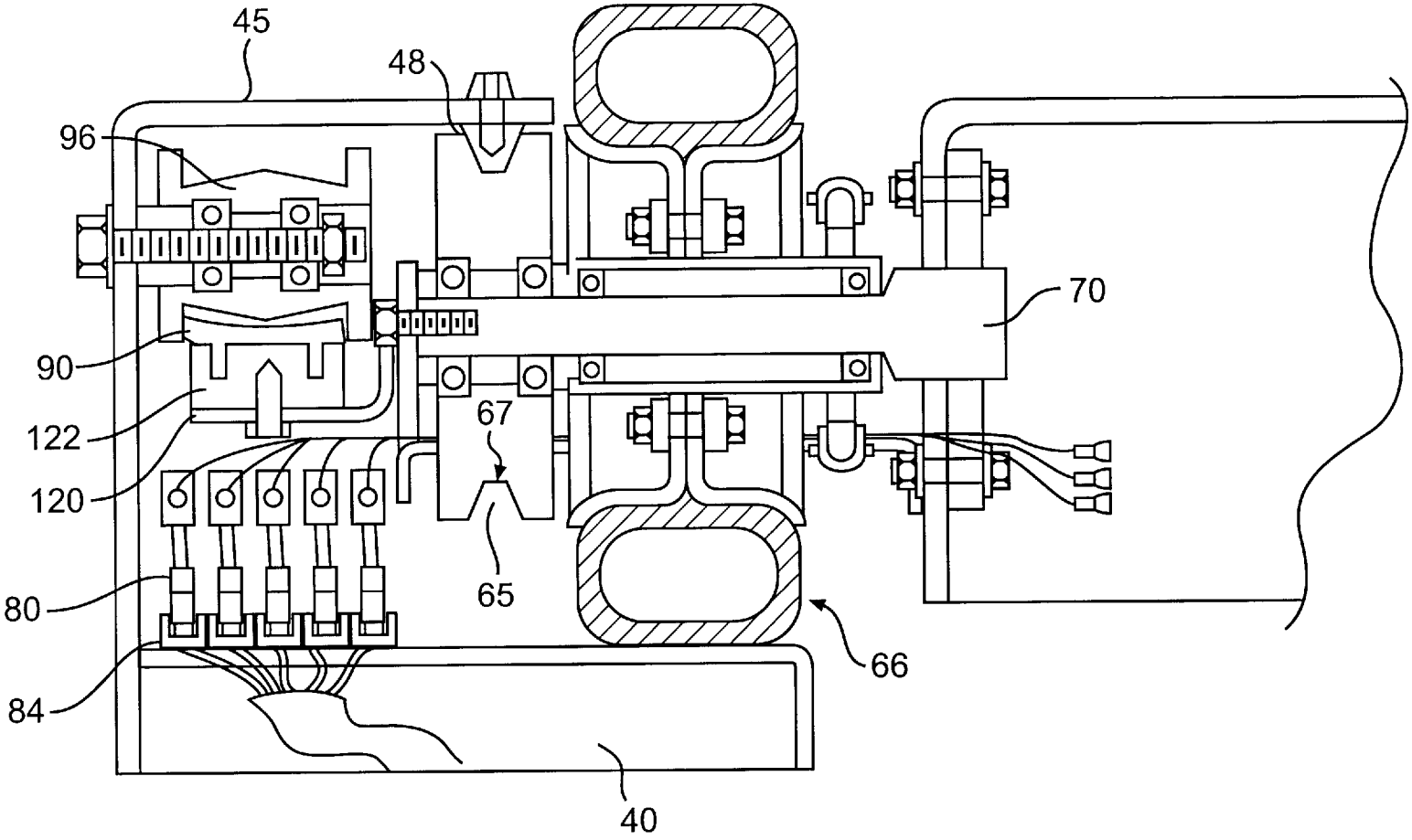
FIG. 18 is a cross-sectional view of an embodiment of a co-axial wheel pair of the present invention.

As shown in FIG. 18, and as an alternative to the use of flange 47 to prevent side-to-side movement of the film dispenser, an extruded portion 48 may be taped, bolted, glued, or otherwise fixed to corner portion 45, or formed integrally with corner portion 45. First wheel 65 includes a groove 67 of a shape corresponding to extrusion 48, such that first wheel 65 travels along extrusion 48 by setting extrusion 48 into groove 67. As with flange 47 in an earlier embodiment, extrusion 48 and groove 67 prevent side-to-side movement of film dispenser 60. In this embodiment, conventional methods are used to supply current and electrical control to film dispenser 60. For example, commutator rings, electrical collector rings, or slip rings are used. Current may be supplied by a conventional commutator ring system. As shown in FIG. 18, followers 80 slide in commutator rings 84 which are attached to base 40 to provide current and electrical control to film dispenser 60.

Figure 19:
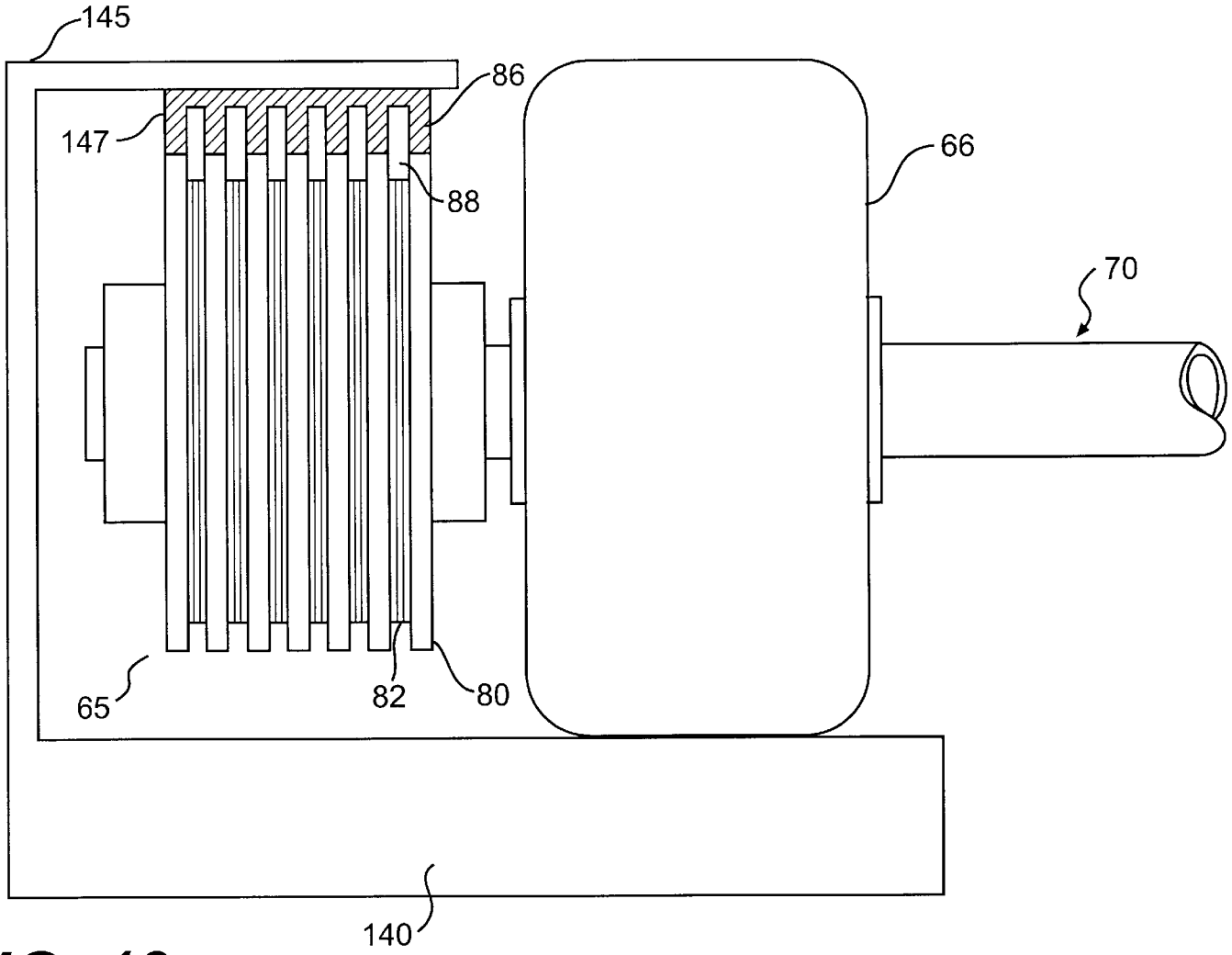
FIG. 19 is a cross-sectional view of another embodiment of a co-axial wheel pair of the present invention.
Figure 20:
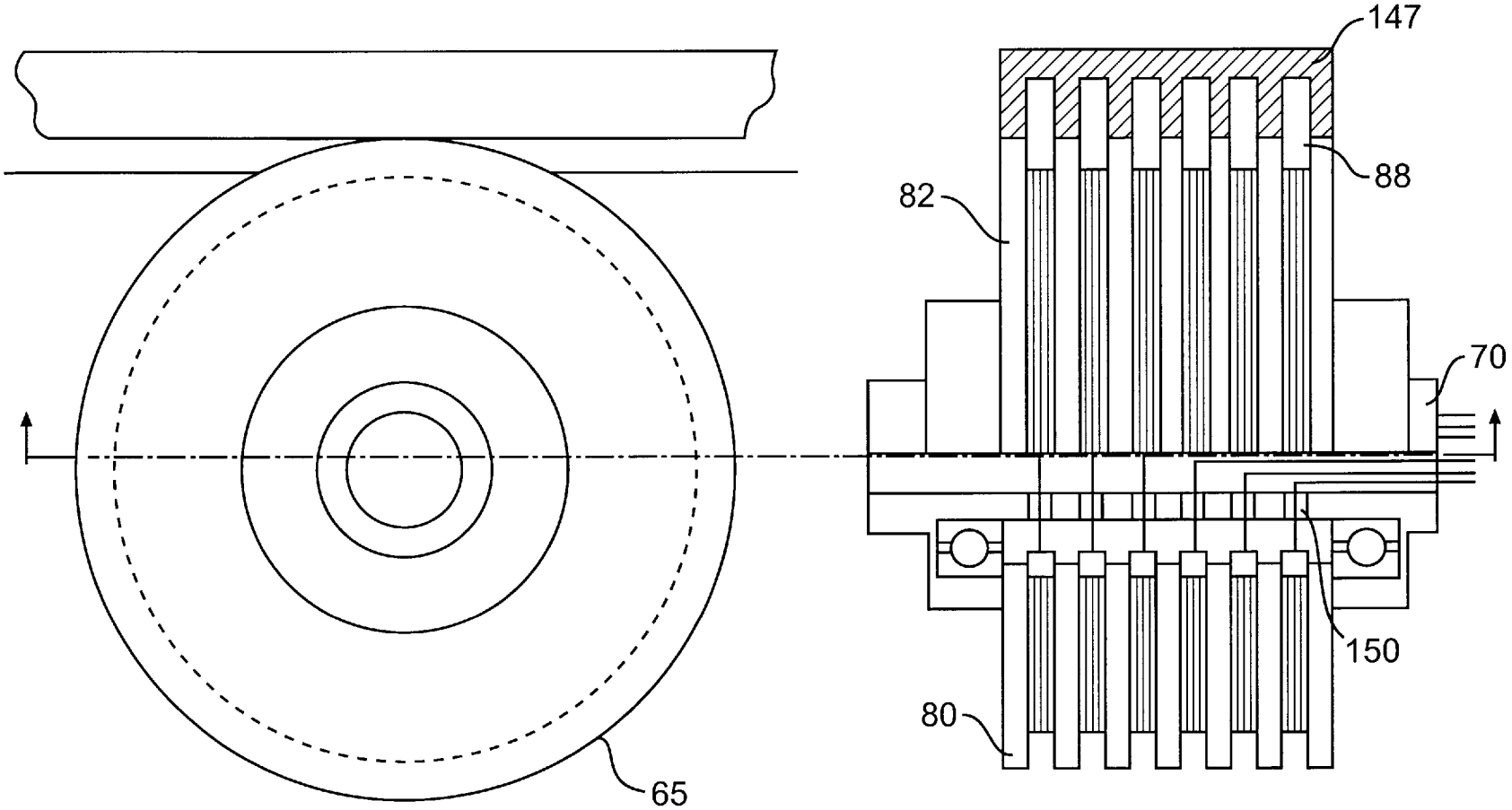
FIG. 20 is a side and cross-sectional view of the first wheel of FIG. 19.

As shown in FIG. 19, and as a further alternative to the use of flange 47, first wheel 65 may take the form of a disc "sandwich" comprising alternating discs 80 of nylon or another appropriate force bearing and insulating material, and discs 82 of copper or other conductive material. This configuration also replaces conventional methods of supplying electricity to film dispenser 60. Connection fingers 88 contact copper discs 82 to supply current and electrical control discs 82. Discs 82 supply electricity to inner brushes 150 which, in turn, supply electricity to all electrical devices within film dispenser 60. As embodied herein, the shaft 70 is stationary and wheels 65, 66 spin about it. Alternatively, it would be possible to have rotating axles. In this embodiment, each track segment includes an insulating material 86 with metal connection fingers 88 extending therefrom. As copper discs 82 rotate, metal fingers 88 contact copper discs 82 and electricity is supplied from stationary fingers 88 which is thus supplied to film dispenser 60 traveling along tracks 20.

Figure 17B:
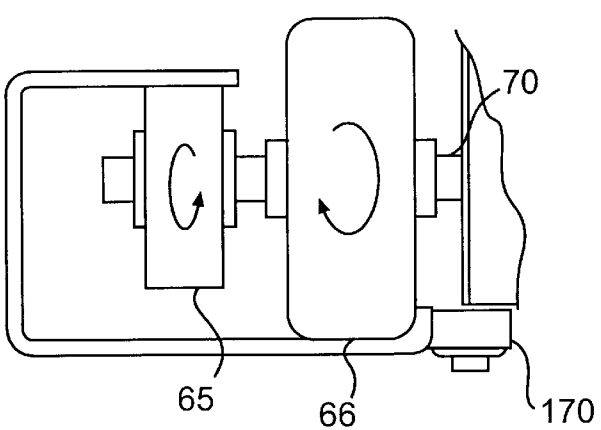
FIGS. 17A–17D are cross-sectional views of various embodiments of a co-axial wheel pair and means for guiding the wheel pair of the present invention.
Figure 17D:
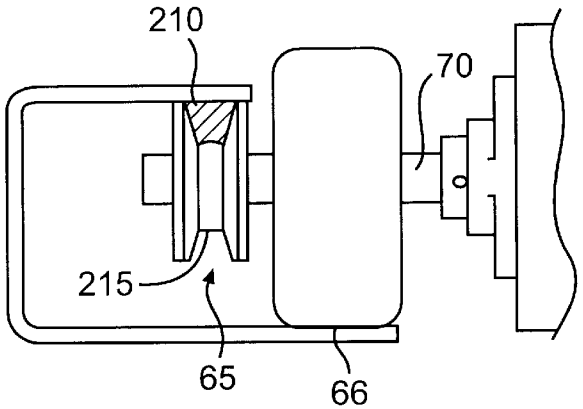
Figure 17A:
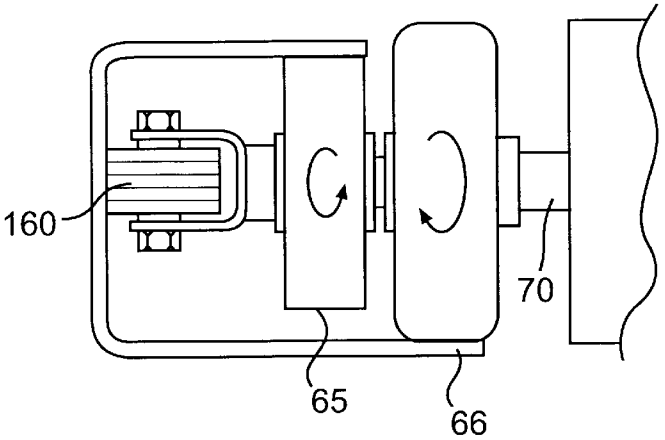
Figure 17C:
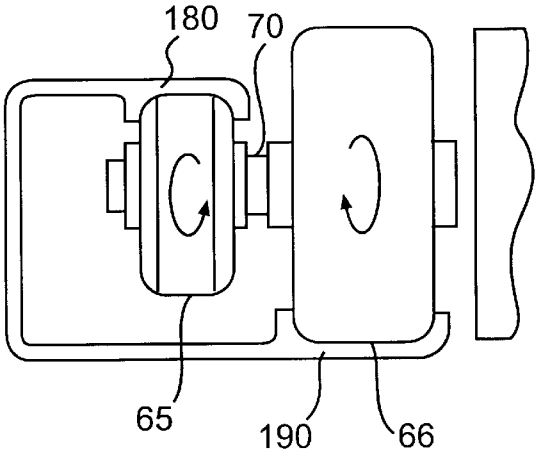

Even further alternatives to the described apparatus for guiding the wheels of the film dispenser are shown and described in FIGS. 17A–17D. FIG. 17A shows a pivoting or nonpivoting caster wheel or tire 160 attached to axle 70 for guiding the wheels along the rails. FIG. 17B shows a caster or cam follower 170 mounted to film dispenser 60 so that caster or cam follower 170 rides against the frame. FIG. 17C shows troughs 180 and 190 for wheels 65 and 66 to ride in respectively. FIG. 17D shows a v-belt 210 or a similarly shaped extrusion which rides in a corresponding groove 215 in wheel 65, 66. A similar extrusion and groove can be used for wheel 66.

The drive mechanism that drives the film dispenser around tracks 20 will now be described. In accordance with one aspect of the present invention, film dispenser 60 may contain a motor to provide power to film dispenser 60 to travel around tracks 20 of the wrapping frame. In accordance with another aspect of the present invention, film dispenser 60 may be driven by a drive mechanism that includes a flexible connector, a motor, and a pulley system shown and described with reference to FIGS. 22–25. The drive mechanism includes at least one flexible connector 90 for connecting a motor car 92 to film dispenser 60. Flexible connector 90 may be a cable, belt, chain, rope, or other suitable connector of sufficient flexibility. Flexible connector 90 is connected to film dispenser 60 and motor car 92.

Figure 22:
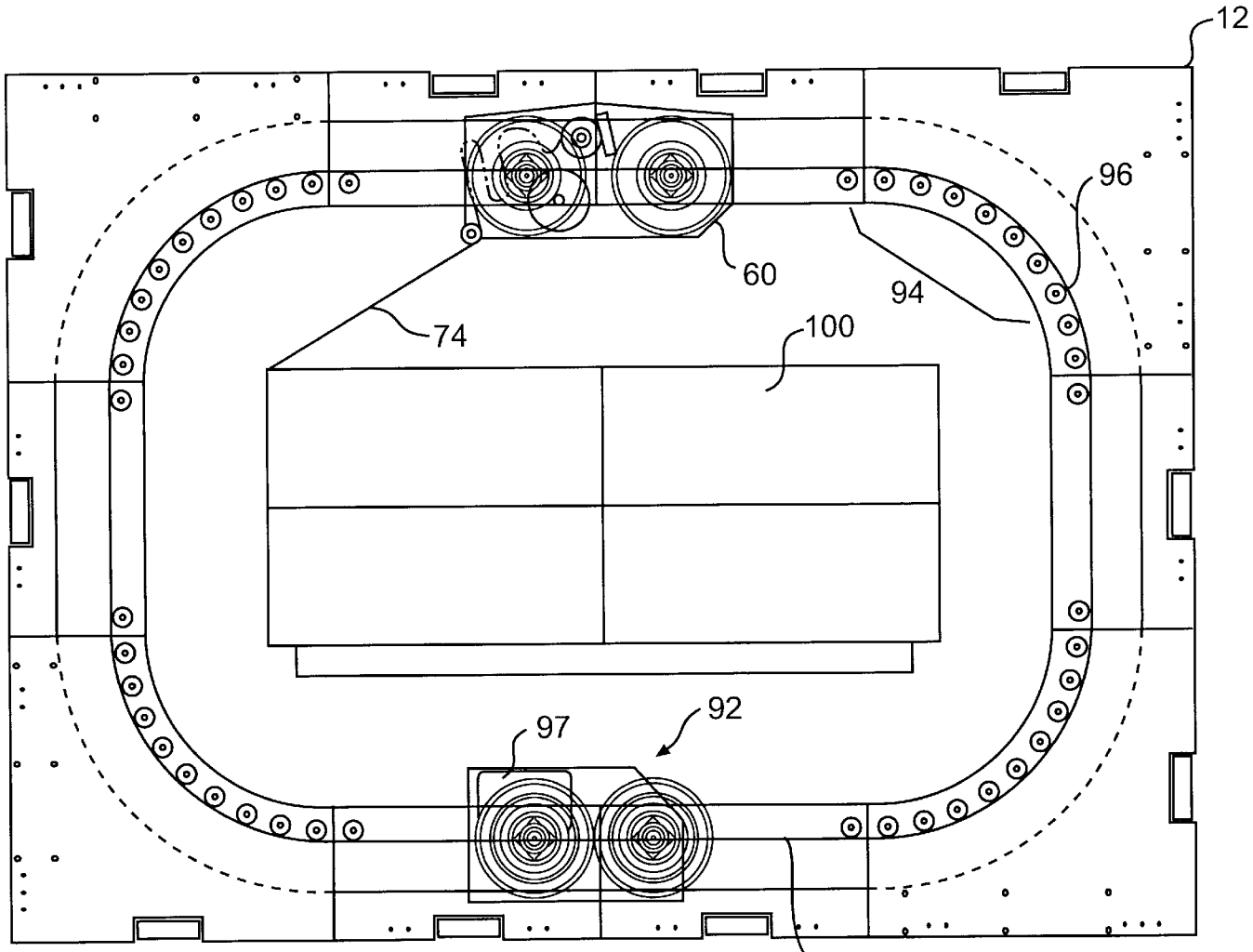
FIG. 22 is a schematic sectional view of an embodiment of the film dispensing mechanism of FIG. 15 located on the track of the wrapping frame of FIGS. 5 and 11 and being driven by the drive mechanism of FIG. 21.

Flexible connector 90 is supported around the circumference of wrapping frame 12 by a pulley system 94. As shown in FIG. 22, pulley system 94 a plurality of pulleys 96 located at each corner of wrapping frame 12. In the embodiment shown in FIG. 22, eleven plastic pulleys 96 each with a 2 inch outer diameter and a 2 inch width, are used in each corner of frame 12 to hold are used to support flexible connector 90. This large number of pulleys 96 prevents the length of flexible connector 90 from changing or becoming slack during use. The number, size and width of these pulleys may be altered to accomodate changes in the type of flexible connector used. For example, four pulleys, one in each corner of the frame, may be used. In such an embodiment, it would be desirable to have means for taking up slack of the flexible connector within the cars traveling around the frame.

Figure 21:
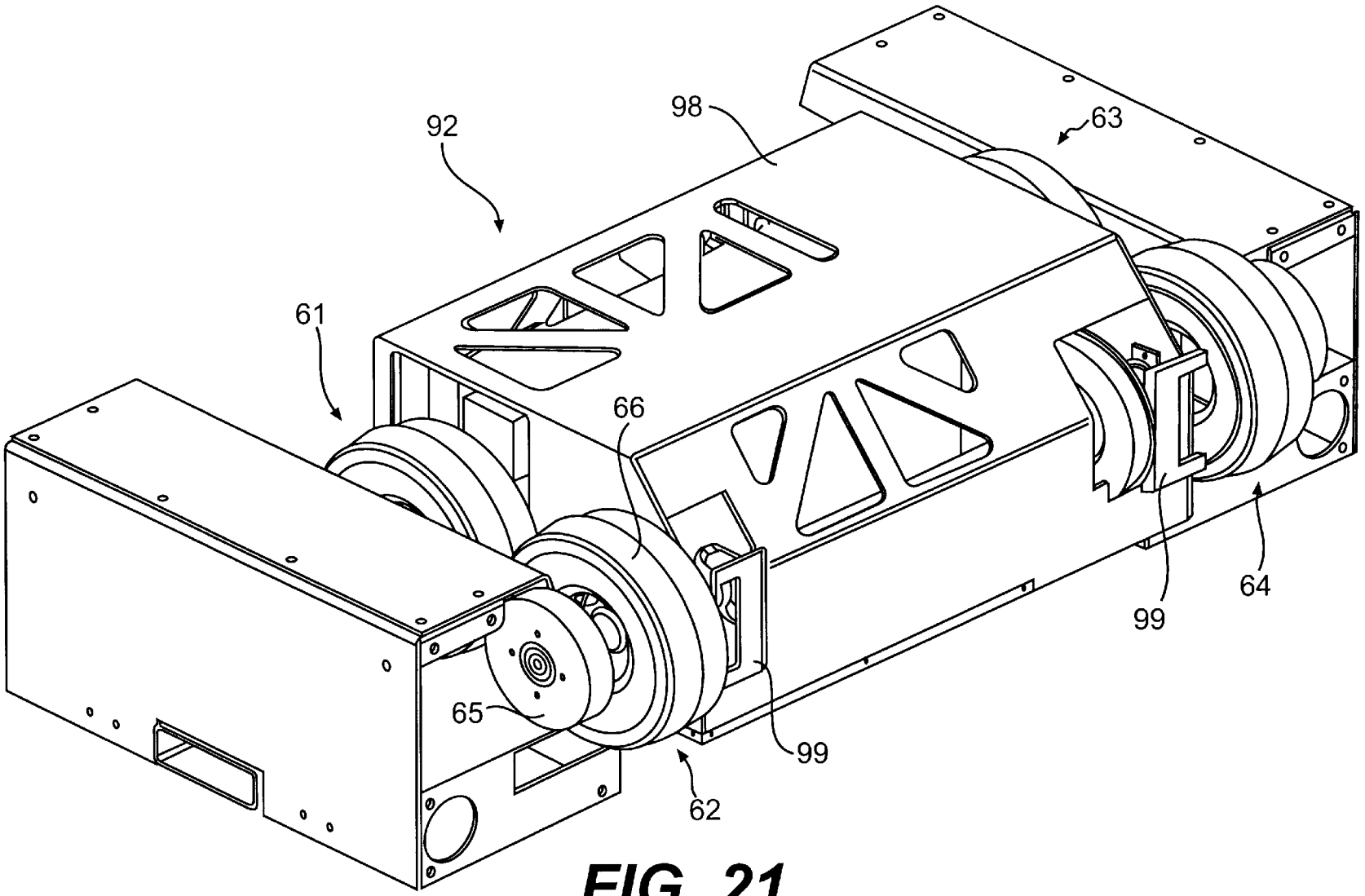
FIG. 21 is an isometric view of an embodiment of a drive mechanism of the present invention located on the tracks of the wrapping frame of FIG. 11.

Motor car 92 includes a motor 97, a motor car housing 98, and car connectors 99, as shown in FIG. 21. Motor car 92 further includes four pairs 61, 62, 63, 64 of wheels, each having a first wheel 65 and a second wheel 66. The structure and operation of these pairs of wheels are the same as those described earlier in the discussion of film dispenser 60. It is to be understood that the various arrangements of wheels and apparatus to guide the wheels described earlier in connection with film dispenser 60 apply to motor car 92.

Motor car housing 98 is mounted on axles that connect the pairs of co-axial wheels. Motor 97, located within housing 98, must have sufficient power to drive motor car 92 and film dispenser 60 around the tracks of the wrapping frame. As shown in FIG. 18, car connectors 99 are located on housing 98 and may be used to connect motor car 92 directly to film dispenser 60 without the use of flexible connector 90. Flexible connector 90 is attached in the same manner as described in the above discussion of film dispenser 60.

As shown in FIG. 22, in the embodiment where motor car 92 and flexible connector 90 are used, motor car 92 is preferably positioned 180 degrees away from film dispenser 60 on the opposite side of tracks 20 to balance the weight. Motor 97 in motor car 92 provides movement of motor car 92 and of the attached flexible connector 90. As flexible connector 90 moves, it pulls film dispenser 60 so that film dispenser 60 dispenses and wraps stretch wrap material 74 around load 100.

Figure 23:
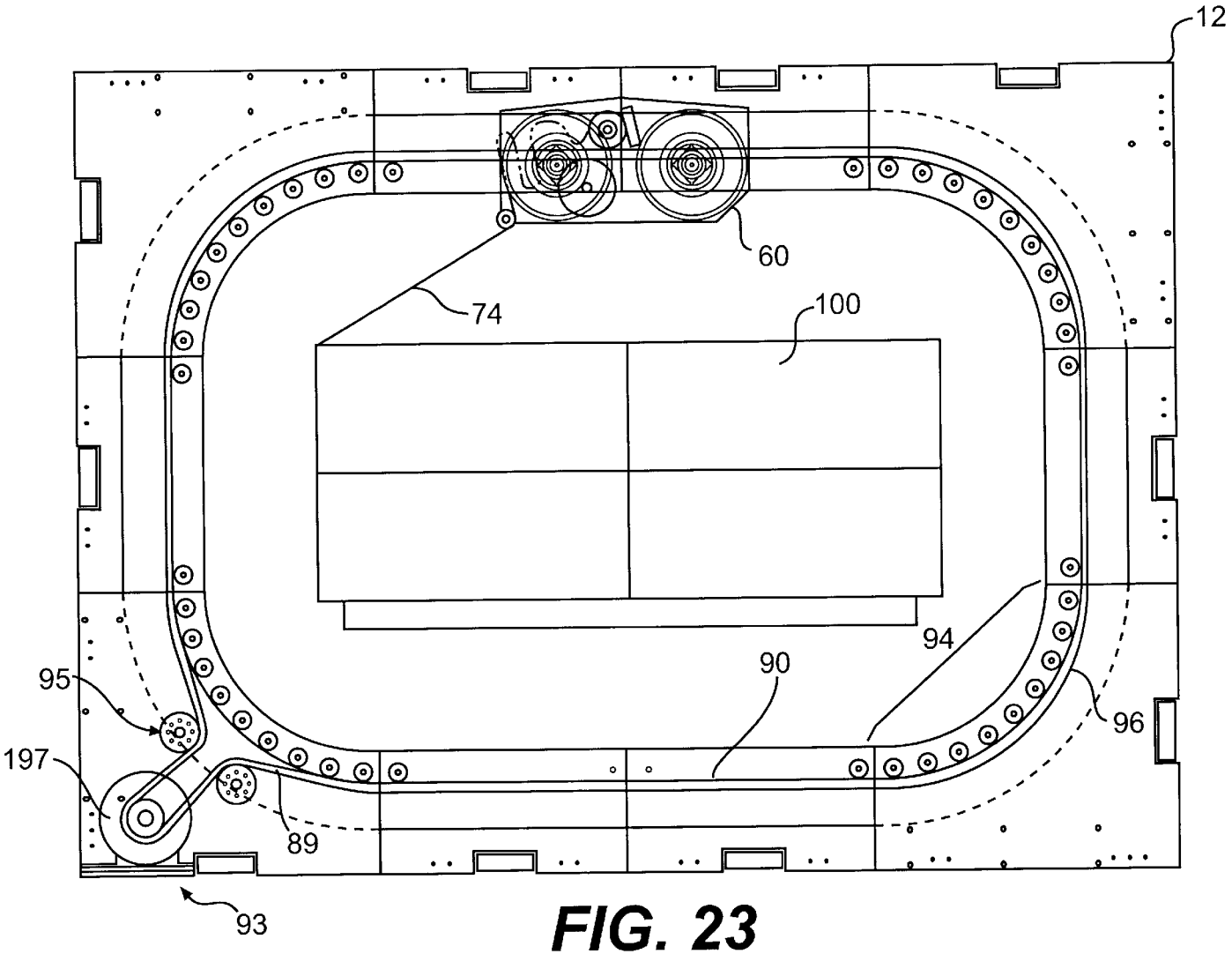
FIG. 23 is a schematic sectional view of an embodiment of the film dispensing mechanism of FIG. 15 located on the track of the wrapping frame of FIGS. 5 and 11 and being driven by another embodiment of a drive mechanism according to the present invention.
Figure 24:
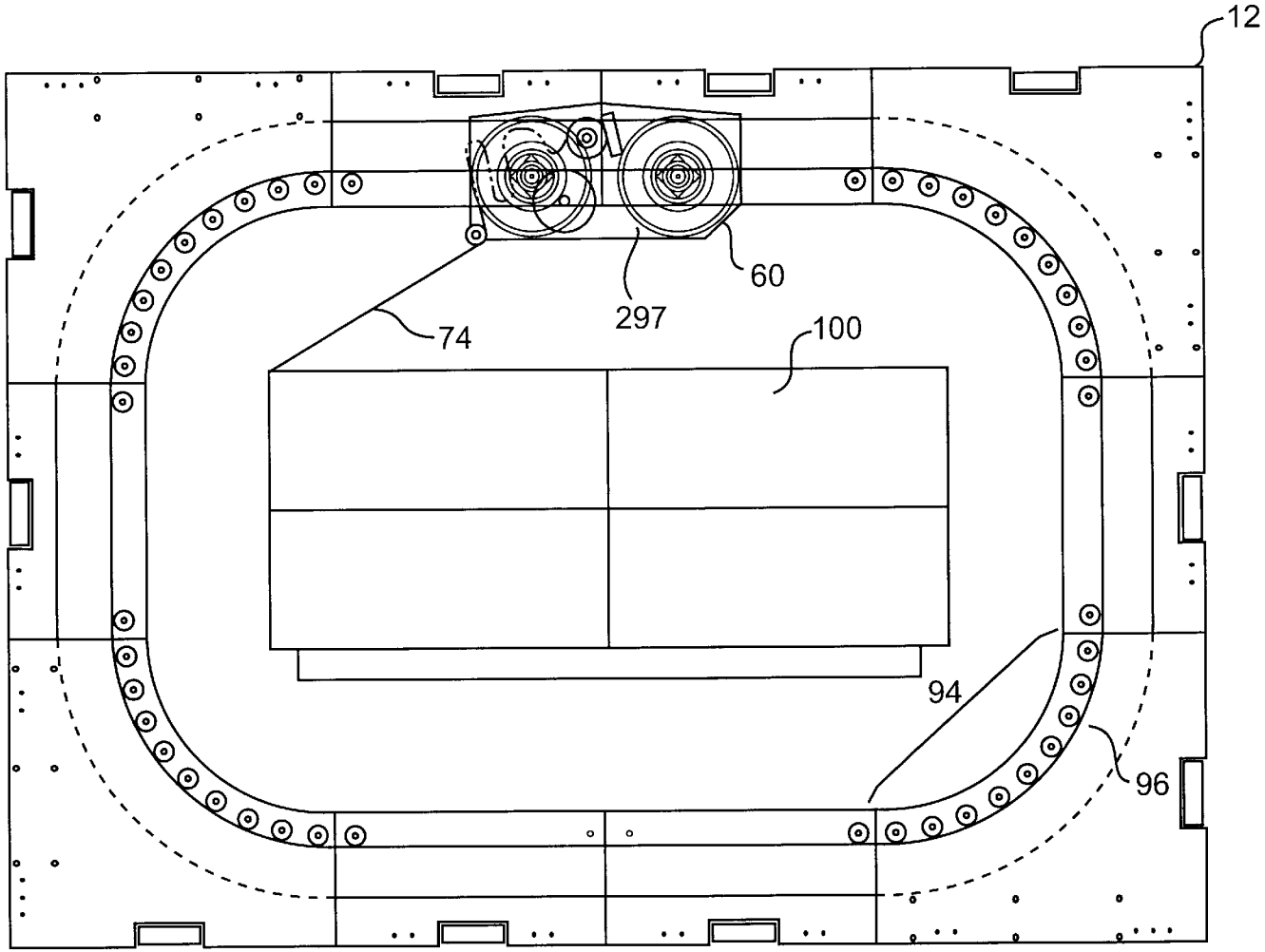
FIG. 24 is a schematic sectional view of another embodiment of the film dispensing mechanism located on the track of the wrapping frame of FIGS. 5 and 11.
Figure 25:
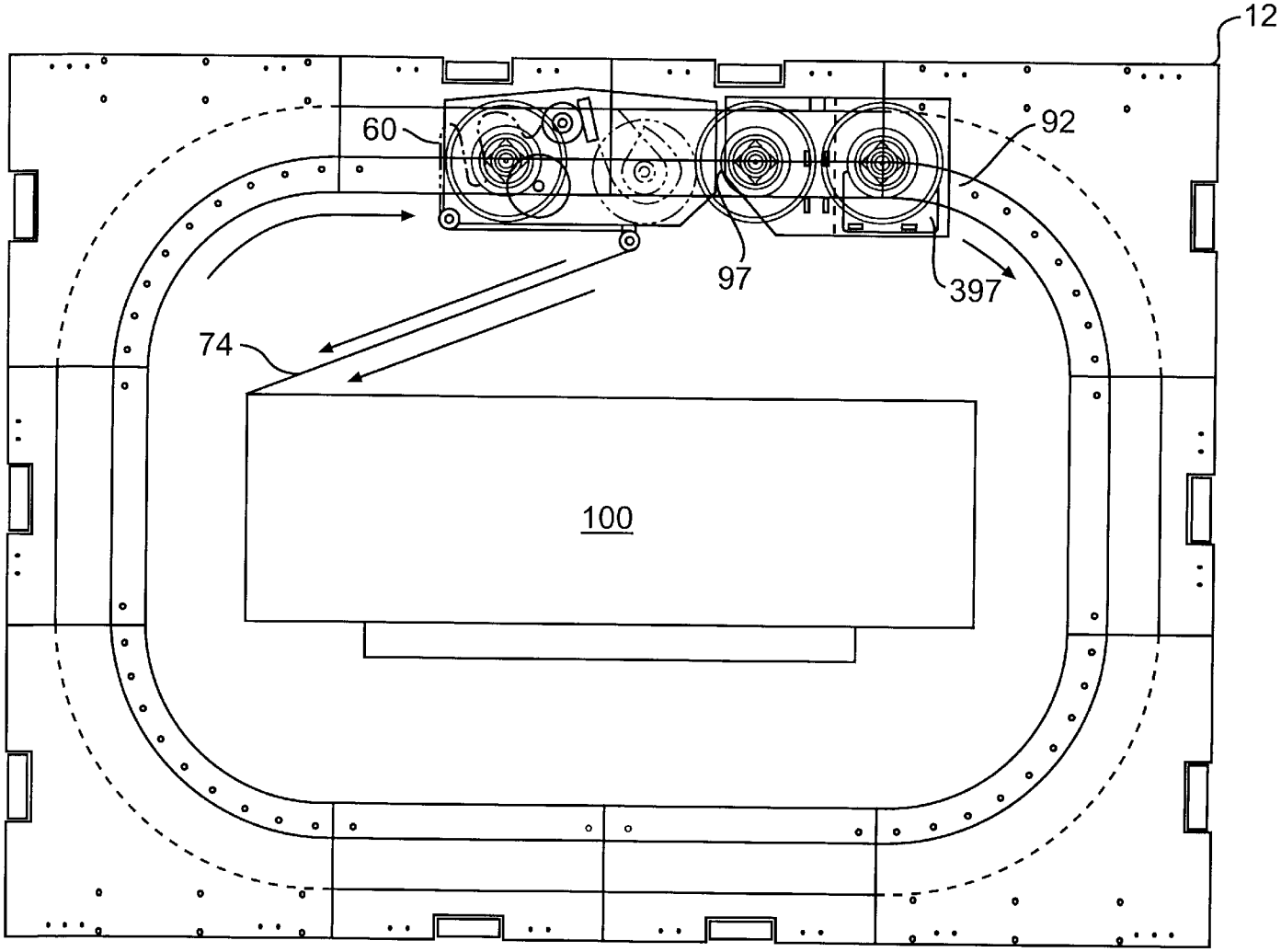
FIG. 25 is a schematic sectional view of an embodiment of the film dispensing mechanism of FIG. 15 located on the tracks of the wrapping frame of FIG. 11 and connected directly to an embodiment of the drive mechanism of FIG. 20.

As an alternative to the drive mechanism just described, FIG. 23 shows a drive mechanism that includes a flexible connector 90, a pulley system 94, a power source such as a motor 197, and an outside drive 93. Flexible connector 90 and pulley system 94 are similar in structure described in connection with the embodiment shown in FIG. 22. Outside drive 93 includes a drive belt 89 laid over top of and in contact with flexible connector 90, and a secondary pulley system 95. Motor 197 is connected to and drives pulley system 95 which provides movement of drive belt 89. As drive belt 89 is in contact with flexible connector 90, the movement of drive belt 89 causes flexible connector 90 to move, ultimately causing movement of film dispenser 60 to dispense and wrap a load 100.

As shown in FIGS. 18 and 22–25, film dispenser 60 and motor car 92 are connected to flexible connector 90 at axles 70 of dispenser 60 and car 92. The axles are at the center of rotation and stay spaced at a constant distance from the rails while traveling around tracks 20. Thus, the position of flexible connector 90 remains constant at the level of and even with the center of rotation. As shown in FIG. 18, the top of flexible connector 90 is aligned with the exact center of rotation of the co-axial wheel pairs, i.e. axle 70. A connection piece 120 connects to and extends from axle 70 via a screw or other similar fastening mechanism. A pad 122 is secured onto connection piece 120 also by a screw or other similar fastening mechanism. Flexible connection is similarly secured to pad 122. In operation, when flexible connector 90 moves, pad 122, connection piece 120, and axle 70 move with flexible connector 90.

In the embodiments where film dispenser 60 is provided with a motor 297 therein (FIG. 24) or film dispenser 60 is directly attached to motor car 92 (FIG. 25), it is not necessary to use flexible connector 90. These embodiments have the advantage of being able to be quickly adapted to various size frames, without having to adjust the length of flexible connector 90. This also reduces the assembly time of the wrapping frame, as the belts and pulleys are not needed. In addition, maintenance is quicker and easier because film dispenser 60 and the drive mechanism are a one piece structure.

The embodiments where film dispenser 60 is driven by either motor car 92 connected by flexible connector 90 (FIG. 22) or by outside drive 93 (FIG. 23) evenly distribute weight around the wrapping frame, as discussed earlier. This, in turn, reduces the need for reinforcing the wrapping frame for stability. Use of flexible connector 90 also enables a reduction in motor size and power.

Other embodiments of the invention will be apparent to those skilled in the art from considering the specification and practicing the invention disclosed herein. It is intended that the specification and examples be considered as exemplary only, with true scope and spirit of the invention being indicated by the following claims and their equivalents.

We claim:

1. An apparatus for wrapping a load comprising:

a packaging material dispenser for dispensing stretch wrap packaging material;

a segmented wrapping frame for supporting the packaging material dispenser, the frame comprising segments of track which are assembled to one another to form a track for the packaging material dispenser so the packaging material dispenser can revolve around the load, wherein at least one of the assembled segments is adjustable in length; and a motor for driving the packaging material dispenser around the load to wrap packaging material around the load.

2. The apparatus of claim 1, wherein the track forms a non-circular path.

3. The apparatus of claim 1, wherein the track forms a rectangular path.

4. The apparatus of claim 1, wherein the track segments include at least one curved segment and at least one straight segment.

5. The apparatus of claim 1, wherein the track segments include at least two similarly sized and shaped curved segments and at least two similarly sized and shaped straight segments.

6. The apparatus of claim 1, wherein the track segments are permanently assembled to each other.

7. The apparatus of claim 1, wherein the track segments are releasably assembled to each other.

8. The apparatus of claim 1, wherein the segments include telescoping adjustable-length segments.

9. The apparatus of claim 1, including a controller for automatically changing the length of at least one segment while the segments are assembled.

10. The apparatus of claim 1 wherein the packaging material dispenser is a stretch wrap packaging dispenser for dispensing stretch wrap packaging material.

11. An apparatus for packaging a load comprising:

a packaging material dispenser for dispensing packaging material around a load the dispenser having a body, a first pair of co-axial wheels having first and second wheels rotatable about a first axis;

a wrapping frame for supporting the packaging material dispenser, the frame having a first rail for contacting the first wheel of the first pair of co-axial wheels and a second rail for contacting the second wheel of the first pair of co-axial wheels, permitting the packaging material dispenser to travel around a track, wherein the first and second wheels are positioned to rotate in different directions when moving on said first and second rails; and a motor for driving the packaging material dispenser around the track to wrap packaging material around the sides of the load.

12. The apparatus of claim 11, wherein the wrapping frame has a second track with first and second rails.

13. The apparatus of claim 11 including a second pair of co-axial wheels having first and second wheels rotatable about a second axis, wherein the first axis is offset from the second axis.

14. The apparatus of claim 11, wherein the radius of the first wheel is less than the radius of the second wheel.

15. The apparatus of claim 11, wherein the first wheel is deformable and the second wheel is non-deformable.

16. The apparatus of claim 11, wherein at least one of the wheels includes a pneumatic tire.

17. The apparatus of claim 11 wherein the track includes track segments which are assembled to one another, each segment having a base section and a corner portion which retains the packaging material dispenser wheels on the track.

18. The apparatus of claim 17 wherein the track has first and second rails and the corner portion further includes a flange portion, the first and second wheels of the packaging material dispenser riding on the first and second rails and the flange portion sitting between the first and second wheels.

19. The apparatus of claim 11 wherein the packaging material dispenser is a stretch wrap packaging dispenser for dispensing stretch wrap packaging material.

20. An apparatus for packaging a load comprising:

a packaging material dispenser for dispensing packaging material;

a segmented wrapping frame for supporting the packaging material dispenser, the frame having first and second tracks for the packaging material dispenser to travel around;

a motor for driving the packaging dispenser around the tracks to wrap packaging material around the load;

a flexible connector supported around a perimeter of the tracks and connected to the packaging material dispenser; and supports for the flexible connector positioned around the perimeter of the tracks.

21. The apparatus of claim 19 including pairs of co-axial wheels mounted on an axle of the packaging materials dispenser, wherein the flexible connector is aligned with the center of the axis of rotation of the wheels.

22. The apparatus of claim 19, including a drive belt, wherein the motor is stationary and drives the drive belt which drives the flexible connector.

23. The apparatus of claim 20 wherein the packaging material dispenser is a stretch wrap packaging dispenser for dispensing stretch wrap packaging material.

24. The apparatus of claim 19, including a motor car separate from the packaging material dispenser, wherein the motor is provided in the motor car, and the motor cars pulls the packaging material dispenser around the track by the flexible connector.

25. The apparatus of claim 24, wherein the motor car includes a body and at least two pairs of co-axial wheels, a first pair of co-axial wheels having first and second wheels rotatable about a first axis and a second pair of co-axial wheels having first and second wheels rotatable about a second axis, the first axis being offset from the second axis.

26. The apparatus of claim 25 wherein the packaging material dispenser and the motor car are connected by the flexible connector so that the packaging material dispenser is located opposite the motor car on the tracks.

27. The apparatus of claim 25 wherein the flexible connector is aligned with the center of the axis of rotation of the wheels.

28. The apparatus of claim 24 wherein the packaging material dispenser and the motor car are proximate to each other.

29. A method of wrapping a load, comprising:

determining a shape and size of a load to be wrapped;

determining whether the shape and size of an assembled segmented wrapping frame is desirable for the shape and size of the load;

automatically changing the shape and size of the segmented wrapping frame to improve the desirability of shape and size of the wrapping frame in relation to the shape and size of the load by adjusting the length of at least one segment of the assembled segmented wrapping frame; and driving a packaging material dispenser around the frame to wrap packaging material around the load.

30. The method of claim 29 wherein the driving step includes driving a stretch wrap packaging material dispenser around the frame to wrap stretch wrap packaging material around the load.

31. An apparatus for packaging a load comprising:

a packaging material dispenser for dispensing packaging material around a load the dispenser having a body, a first pair of co-axial wheels having first and second wheels rotatable about a first axis;

a wrapping frame for supporting the packaging material dispenser, the frame having a first rail having a surface for contacting the first wheel of the first pair of co-axial wheels and a second rail having a surface for contacting the second wheel of the first pair of co-axial wheels, permitting the packaging material dispenser to travel around the track, wherein the contacting surfaces of the first and second rails are non co-planar and facing in opposite directions; and a motor for driving the packaging dispenser around the track to wrap packaging material around the sides of the load.

32. The apparatus of claim 31 wherein the packaging material dispenser is a stretch wrap packaging dispenser for dispensing stretch wrap packaging material.

* * * * *

UNITED STATES PATENT AND TRADEMARK OFFICE

CERTIFICATE OF CORRECTION

PATENT NO. : 5,850,726
DATED : December 22, 1998
INVENTOR(S) : Steven E. Degrasse, et al.

It is certified that error appears in the above-identified patent and that said Letters Patent is hereby corrected as shown below:

Title page,
Item [75], in the inventors, line 1, "Degrasse" should read -- DeGrasse --.

Signed and Sealed this

Twenty-first Day of August, 2001

*Attest:*

Nicholas P. Godici

NICHOLAS P. GODICI
*Acting Director of the United States Patent and Trademark Office*

*Attesting Officer*